US012716192B2

(12) United States Patent
Narikawa et al.

(10) Patent No.: US 12,716,192 B2
(45) Date of Patent: Aug. 25, 2026

(54) WORK MACHINE

(71) Applicant: HITACHI CONSTRUCTION MACHINERY CO., LTD., Tokyo (JP)

(72) Inventors: Ryu Narikawa, Tokyo (JP); Hidekazu Moriki, Tokyo (JP); Hiroshi Sakamoto, Tsuchiura (JP); Hiroaki Tanaka, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 618 days.

(21) Appl. No.: 17/607,954

(22) PCT Filed: Jun. 16, 2020

(86) PCT No.: PCT/JP2020/023628
§ 371 (c)(1),
(2) Date: Nov. 1, 2021

(87) PCT Pub. No.: WO2020/255970
PCT Pub. Date: Dec. 24, 2020

(65) Prior Publication Data

US 2022/0316173 A1 Oct. 6, 2022

(30) Foreign Application Priority Data

Jun. 19, 2019 (JP) ..... 2019-114014

(51) Int. Cl.
*E02F 3/43* (2006.01)
*E02F 3/32* (2006.01)
*E02F 9/26* (2006.01)

(52) U.S. Cl.
CPC ..... *E02F 3/435* (2013.01); *E02F 3/32* (2013.01); *E02F 9/265* (2013.01)

(58) Field of Classification Search
CPC ... E02F 3/435; E02F 3/32; E02F 9/265; E02F 9/2203; E02F 9/262; E02F 9/2033; E02F 3/425; E02F 9/22; E02F 3/43; E02F 9/20
See application file for complete search history.

(56) References Cited

U.S. PATENT DOCUMENTS 5,490,081 A 2/1996 Kuromoto et al.
2016/0097184 A1* 4/2016 Matsuyama ..... E02F 9/2033 701/50

(Continued)

FOREIGN PATENT DOCUMENTS

CN 105518222 B 2/2018
CN 107949676 A 4/2018

(Continued)

OTHER PUBLICATIONS

Chinese Office Action received in corresponding Chinese Application No. 202080042344.2 dated Jul. 21, 2022.

(Continued)

*Primary Examiner* — Jason Holloway
*Assistant Examiner* — Elizabeth Rose Neleski
(74) *Attorney, Agent, or Firm* — MATTINGLY & MALUR, PC

(57) ABSTRACT

A hydraulic excavator having a plurality of front implement members, including a bucket, has a controller that controls the work implement by using: excavation assistance control that controls the work implement such that the bucket moves along a predetermined target excavation surface; and deviation prevention control that prevents deviation of the work implement from a predetermined work area by decelerating or stopping operation of a subject front implement member that is included in the plurality of front implement members and that can deviate the work implement from the work area. The controller controls the work implement such that when the controller controls the work implement by using both the (Continued)

excavation assistance control and the deviation prevention control, an operation direction of the bucket approximates to an operation direction of the bucket that is to be generated when the work implement is controlled by using only the excavation assistance control.

12 Claims, 11 Drawing Sheets

(56) References Cited

U.S. PATENT DOCUMENTS

| | | | | |
|---|---|---|---|---|
| 2016/0273186 | A1 | 9/2016 | Kami et al. | |
| 2017/0089033 | A1* | 3/2017 | Matsuyama | E02F 9/2285 |
| 2018/0266079 | A1 | 9/2018 | Morita et al. | |
| 2019/0169818 | A1 | 6/2019 | Narikawa et al. | |
| 2021/0010227 | A1* | 1/2021 | Izumikawa | E02F 9/2282 |
| 2022/0106769 | A1* | 4/2022 | Takaoka | E02F 3/841 |

FOREIGN PATENT DOCUMENTS

| | | | | |
|---|---|---|---|---|
| JP | 05-321290 | A | 7/1993 | |
| JP | 2017-210817 | A | 11/2017 | |
| JP | 2017-226972 | A | 12/2017 | |
| JP | 6752193 | B2 * | 9/2020 | E02F 3/435 |
| WO | 2014/167718 | A1 | 10/2014 | |
| WO | 2015/181990 | A1 | 12/2015 | |
| WO | 2017/168686 | A1 | 10/2017 | |

OTHER PUBLICATIONS

Korean Office Action received in corresponding Korean Application No. 10-2021-7038748 dated Apr. 12, 2023.

International Search Report of PCT/JP2020/023628 dated Sep. 8, 2020.

International Preliminary Report on Patentability of PCT/JP2020/023628 dated Dec. 30, 2021.

* cited by examiner

WORK MACHINE

TECHNICAL FIELD

The present invention relates to a work machine.

BACKGROUND ART

As a technology that enhances the work efficiency of a work machine (e.g. a hydraulic excavator) including a work implement (e.g. an articulated front work implement having a plurality of front implement members such as a boom, an arm, and a work tool (attachment)) driven by hydraulic actuators, there is machine control (Machine Control: MC). MC is a technology that assists operation performed by an operator by executing semi-automatic control of operating a work implement according to predetermined conditions when operation devices are operated by the operator.

Examples of MC include a technology of assisting an operator to form a current terrain profile into a desired profile. Regarding this technology, Patent Document 1 discloses a controller of a construction machine that determines a limited velocity of a boom from a limited velocity of an entire work implement, an arm target velocity, and a bucket target velocity while defining a distance of the blade tip of a bucket when it is positioned outside (above) a design surface as a positive value, and a velocity in a direction from the inner side (lower side) to the outer side (upper side) of the design surface (hereinafter, referred to also as a "target excavation surface") as a positive value, and controls the boom at the limited velocity of the boom and controls an arm at the arm target velocity when a first limitation condition including that the limited velocity of the boom is higher than a boom target velocity is satisfied.

In addition, as a different example of MC, there is a technology of preventing deviation of an excavator from a preset area (hereinafter, referred to also as a "work area"). In relation to this technology, Patent Document 2 discloses a technology of providing a dangerous area (hereinafter, referred to also as an "entry prohibited area") in an operation area space of a work implement (front work implement), decelerating a velocity of the work implement before the dangerous area, and stopping the work implement just before the dangerous area.

PRIOR ART DOCUMENT

Patent Documents

Patent Document 1: WO2014/167718
Patent Document 2: JP-1993-321290-A

SUMMARY OF THE INVENTION

Problem to be Solved by the Invention

In Patent Document 1, in order to prevent a bucket from moving into a design surface while a sense of discomfort felt by an operator is kept low, a limited velocity of a boom is calculated. Specifically, the limited velocity of the boom is calculated such that a vertical velocity generated by operation of all front implement members does not exceed a vertical limited velocity determined by a distance between the design surface and the bucket blade tip. At this time, vertical velocities of the arm and the bucket are velocities generated by operation by the operator. As a result, a sense of discomfort felt by the operator regarding operation at the time of excavation can be suppressed.

In Patent Document 2, a deceleration area is provided before the dangerous area, and control is performed such that a work implement velocity generated by operator operation does not exceed an upper limit value defined in the deceleration area. Accordingly, an operator can concentrate on excavation work, and thus the burden on the operator at the time of excavator operation can be reduced.

On the other hand, at an actual site, there is a situation where both a design surface and a dangerous area are set. For example, when excavation is performed by using the technologies disclosed in Patent Document 1 and Patent Document 2 in a situation where there is a dangerous area below a design surface, there is a possibility that excavation along the design surface cannot be performed. For example, when excavation along a linear design surface is to be performed, it is necessary to cause a velocity vector generated at the tip of a bucket by the combination of arm crowding operation and boom raising operation to point to a direction along the design surface. At this time, according to the control of Patent Document 1 (referred to as "excavation assistance control" in this document), a limited velocity of a boom for moving the bucket tip along the design surface is calculated with respect to the arm crowding operation according to operator operation. However, when the bucket tip enters a deceleration area, the control of Patent Document 2 (referred to as "deviation prevention control" in this document in some cases) is activated, and arm crowding operation actually generated is decelerated more than expected in the excavation assistance control, and thus the boom raising operation becomes excessive. Accordingly, the bucket tip floats above the design surface, and there is a fear that excavation operation along the design surface cannot be performed.

In addition, in some cases, there is also a situation where there is a dangerous area (e.g. a structure) above a design surface, and a work implement is positioned between the design surface and the dangerous area. When excavation is performed by using the technologies disclosed in Patent Document 1 and Patent Document 2 in such a situation, there is a possibility that a bucket enters the design surface. For example, if the deviation prevention control of Patent Document 2 is activated, and boom raising is decelerated or stopped because a rear end section of an arm approaches a dangerous area above the rear end section when linear excavation along a design surface is being performed by arm crowding operation and the boom raising operation according to the excavation assistance control of Patent Document 1, there is a fear that the boom raising is insufficient for an amount expected in the excavation assistance control, a bucket tip enters the design surface, and excavation operation along the design surface cannot be performed.

As in these cases, in a situation where both a design surface (target excavation surface) and a dangerous area (a work area, an entry prohibited area) are set, there is a fear that the functionalities of the excavation assistance control of Patent Document 1, and the deviation prevention control of Patent Document 2 interfere with each other.

In view of this, an object of the present invention is to provide a work machine that enables excavation along a target excavation surface even in a situation where a work implement is proximate to a work area boundary which is the boundary between a work area and a dangerous area (entry prohibited area) during excavation of the target excavation surface according to excavation assistance control. Note that, as mentioned above, deviation prevention control is control by which entry into the entry prohibited area is prevented, in other words, control by which deviation from the work area is prevented. In addition, the excavation assistance control is control by which a current terrain profile is formed into a profile defined by the desired target excavation surface.

Means for Solving the Problem

The present application includes a plurality of means for solving the problems described above, and an example thereof is a work machine including: a work implement that is attached to a machine body, and has a plurality of front implement members including a work tool; a plurality of actuators that drive the machine body and the plurality of front implement members; an operation device that operates the plurality of actuators; a posture sensor that senses postural data about the machine body and the work implement; an operation sensor that senses operation data about the operation device; and a controller that is capable of controlling the work implement by using excavation assistance control of controlling the work implement such that the work tool moves along a predetermined target excavation surface and deviation prevention control of preventing deviation of the work implement from a predetermined work area by decelerating or stopping operation of a subject front implement member that is included in the plurality of front implement members and that can deviate the work implement from the work area, in which the controller is configured to control the work implement such that when the controller controls the work implement by using both the excavation assistance control and the deviation prevention control, an operation direction of the work tool approximates to an operation direction of the work tool that is to be generated when the work implement is controlled by using only the excavation assistance control.

Advantages of the Invention

According to the present invention, excavation along a target excavation surface becomes possible in a situation where a work machine is proximate to a work area boundary.

MODES FOR CARRYING OUT THE INVENTION

Figure 1:
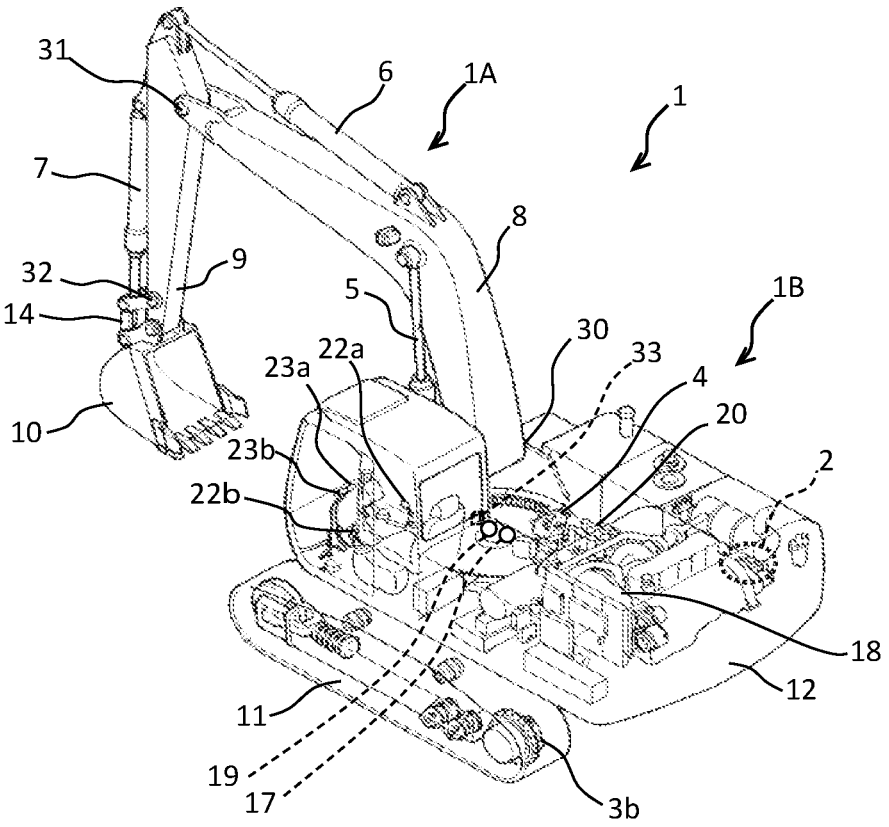
FIG. 1 is a configuration diagram of a hydraulic excavator according to embodiments of the present invention.

Hereinafter, embodiments of the present invention are explained by using the figures. Note that whereas the following illustrates, as a work machine, a hydraulic excavator including a bucket as a work tool (attachment) at the tip of a work implement (front work implement), the present invention may be applied to a work machine including an attachment other than a bucket. In addition, the present invention can also be applied to a work machine other than a hydraulic excavator as long as the work machine has an articulated work implement including a plurality of front implement members (a work tool, a boom, an arm, etc.) that are coupled with each other on a swingable structure.

In addition, in the following explanation, when there are a plurality of identical constituent elements, lowercase letters of the alphabet are given at the ends of reference characters in some cases, but the plurality of constituent elements are denoted collectively by omitting the lowercase letters of the alphabet in some cases. For example, when there are three identical pumps 190*a*, 190*b*, and 190*c*, these are denoted collectively as pumps 190 in some cases.

In addition, a preset area where an excavator can work is referred to as a work area, and a boundary portion defining the work area is referred to as a work area boundary.

Note that in the embodiments depicted below, semi-automatic control, like the excavation assistance control and the deviation prevention control mentioned earlier, that operates a work implement according to predetermined conditions when operation devices are operated by an operator is collectively referred to as "MC."

First Embodiment

Figure 2:
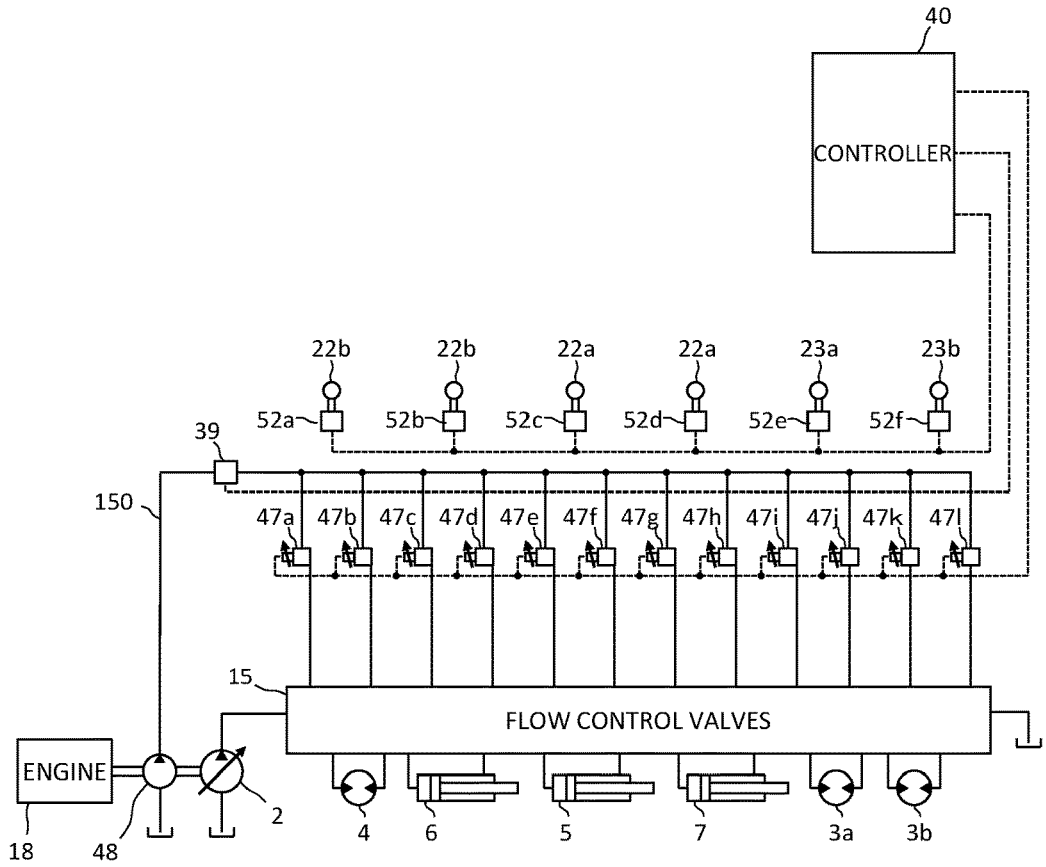
FIG. 2 is a figure depicting a controller of the hydraulic excavator in FIG. 1 along with a hydraulic drive system.

FIG. 1 is a configuration diagram of a hydraulic excavator according to embodiments of the present invention, and FIG. 2 is a figure depicting a controller (controller) 40 of the hydraulic excavator according to the embodiments of the present invention along with a hydraulic drive system.

In FIG. 1, a hydraulic excavator 1 includes an articulated front work implement (work implement) 1A and a body (machine body) 1B. The body (machine body) 1B includes a lower travel structure 11 that travels by using left and right travel hydraulic motors 3*a* and 3*b*, and an upper swing structure 12 that is attached on the lower travel structure 11, is driven by a swing hydraulic motor 4, and can swing in the leftward/rightward direction.

The front work implement 1A includes a plurality of front implement members (a boom 8, an arm 9, and a bucket (work tool) 10) that are individually pivoted vertically, and are coupled with each other. The front work implement 1A is attached to the upper swing structure 12 (machine body 1B). The base end of the boom 8 is pivotably supported at a front section of the upper swing structure 12 via a boom pin 8*a* (see FIG. 3). The arm 9 is pivotably coupled at the tip of the boom 8 via an arm pin 9*a*, and the bucket 10 is pivotably coupled at the tip of the arm 9 via a bucket pin 10*a*. The boom 8 is driven by a boom cylinder 5, the arm 9 is driven by an arm cylinder 6, and the bucket 10 is driven by a bucket cylinder 7.

In order to make it possible to measure pivot angles α, β, and γ (see FIG. 3) of the boom 8, the arm 9, and the bucket 10, a boom angle sensor 30 is attached to the boom pin 8*a*, an arm angle sensor 31 is attached to the arm pin 9*a*, a bucket angle sensor 32 is attached to a bucket link 14, and a body inclination angle sensor 33 that senses an inclination angle θ (see FIG. 3) of the upper swing structure 12 (body 1B) relative to a reference plane (e.g. a horizontal plane) is attached to the upper swing structure 12. Note that each of the angle sensors 30, 31, and 32 can be replaced with an angle sensor (e.g. an inertial measurement unit (IMU: Inertial Measurement Unit)) that senses an angle relative to the reference plane (e.g. the horizontal plane). Alternatively, a cylinder stroke sensor that senses the stroke of each of the hydraulic cylinders 5, 6, and 7 may be used alternatively, and the obtained cylinder stroke may be converted into an angle. In addition, a swing angle sensor 17 that can sense a relative angle (swing angle θsw) between the upper swing structure 12 and the lower travel structure 11 is attached near the rotation center between the upper swing structure 12 and the lower travel structure 11. In addition, a swing-angular-velocity sensor 19 that can sense the angular velocity of a swing is attached to the upper swing structure 12.

The five angle sensors 30, 31, 32, 33, and 17 are collectively referred to as a posture sensor 53 (see FIG. 4) that senses postural data about the upper swing structure (machine body) 12 and the front work implement 1A, in some cases.

Operation devices that operate a plurality of the hydraulic actuators 3*a*, 3*b*, 4, 5, 6, and 7 are installed in a cab provided on the upper swing structure 12. Specifically, as the operation devices, a travel right lever 23*a* for operating the travel right hydraulic motor 3*a* (lower travel structure 11), a travel left lever 23*b* for operating the travel left hydraulic motor 3*b* (lower travel structure 11), an operation right lever 22*a* for operating the boom cylinder 5 (boom 8) and the bucket cylinder 7 (bucket 10), and an operation left lever 22*b* for operating the arm cylinder 6 (arm 9) and the swing hydraulic motor 4 (upper swing structure 12) are installed. Hereinbelow, these are collectively referred to as operation levers 22 and 23 in some cases.

An engine 18 which is a prime mover mounted on the upper swing structure 12 drives a hydraulic pump 2 and a pilot pump 48. The hydraulic pump 2 is a variable displacement pump, and the pilot pump 48 is a fixed displacement pump.

In the present embodiment, the operation levers 22 and 23 are electric levers as depicted in FIG. 2. The controller 40 uses operation sensors (operator operation sensors) 52*a* to 52*f* such as rotary encoders or potentiometers to sense data (e.g. operation amounts and operation directions) about operation of the operation levers 22 and 23 by an operator, and sends electric current commands according to the sensed operation data to solenoid proportional valves 47*a*, 47*b*, 47*c*, 47*d*, 47*e*, 47*f*, 47*g*, 47*h*, 47*i*, 47*j*, 47*k*, and 47*l* (hereinafter, collectively referred to as solenoid proportional valves 47*a*-1 in some cases). The solenoid proportional valves 47*a*-1 are provided on a pilot line 150, are driven when commands from the controller 40 are input thereto, output pilot pressures to flow control valves (control valves) 15, and thereby drive the flow control valves 15. The flow control valves 15 are configured to be able to supply a hydraulic fluid from the pump 2 according to the operation data (the pilot pressures from the solenoid proportional valves 47*a* to 47*f* to the flow control valves 15) about the operation levers 22 and 23 to each of the swing hydraulic motor 4, the arm cylinder 6, the boom cylinder 5, the bucket cylinder 7, the travel right hydraulic motor 3*a*, and the travel right hydraulic motor 3*b*. Note that the solenoid proportional valves 47*a* and 47*b* supply pilot pressures to flow control valves 15 that supply the hydraulic fluid to the swing hydraulic motor 4, the solenoid proportional valves 47*c* and 47*d* supply pilot pressures to flow control valves 15 that supply the hydraulic fluid to the arm cylinder 6, the solenoid proportional valves 47*e* and 47*f* supply pilot pressures to flow control valves 15 that supply the hydraulic fluid to the boom cylinder 5, the solenoid proportional valves 47*g* and 47*h* supply pilot pressures to flow control valves 15 that supply the hydraulic fluid to the bucket cylinder 7, the solenoid proportional valves 47*i* and 47*j* supply pilot pressures to flow control valves 15 that supply the hydraulic fluid to the travel right hydraulic motor 3*a*, and the solenoid proportional valves 47*k* and 47*l* supply pilot pressures to flow control valves 15 that supply the hydraulic fluid to the travel right hydraulic motor 3*b*.

A lock valve 39 connected with the controller 40 is included between the pilot pump 48 and the solenoid proportional valves 47*a*-1 on the pilot line 150. A position sensor of a gate lock lever (not depicted) in the cab is connected with the controller 40. When the gate lock lever is at the lock position, the lock valve 39 is locked, and the hydraulic fluid is not supplied to the pilot line 150. When the gate lock lever is at the unlock position, the lock valve 39 is unlocked, and the hydraulic fluid is supplied to the pilot line 150.

The hydraulic fluid delivered from hydraulic pump 2 is supplied to the travel right hydraulic motor 3*a*, the travel left hydraulic motor 3*b*, the swing hydraulic motor 4, the boom cylinder 5, the arm cylinder 6, and the bucket cylinder 7 via the flow control valves 15 driven by pilot pressures. The supplied hydraulic fluid causes the boom cylinder 5, the arm cylinder 6, and the bucket cylinder 7 to expand or contract to thereby pivot the boom 8, the arm 9, and the bucket 10, respectively, and change the position and posture of the bucket 10. In addition, the supplied hydraulic fluid rotates the swing hydraulic motor 4 to thereby swing the upper swing structure 12 relative to the lower travel structure 11. Then, the supplied hydraulic fluid rotates the travel right hydraulic motor 3*a* and the travel left hydraulic motor 3*b* to thereby cause the lower travel structure 11 to travel. Hereinbelow, the travel hydraulic motors 3, the swing hydraulic motor 4, the boom cylinder 5, the arm cylinder 6, and the bucket cylinder 7 are collectively referred to as hydraulic actuators 3 to 7 in some cases.

(System Configuration)

Figure 4:
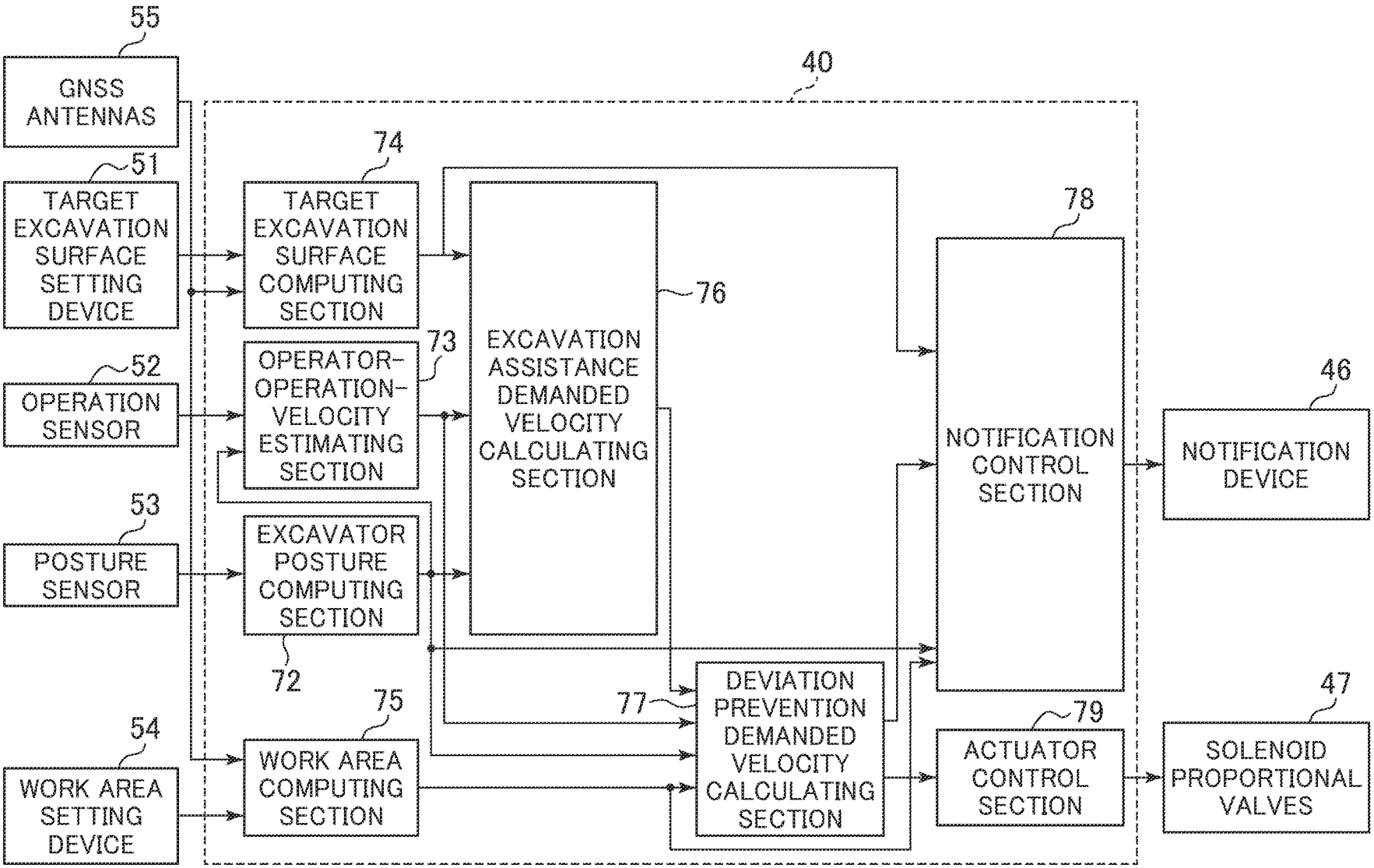
FIG. 4 is a functional block diagram of the controller.

FIG. 4 is a configuration diagram of an MC system included in the hydraulic excavator according to the present embodiment. The MC system in FIG. 4 includes: the controller 40; a target excavation surface setting device 51 which is an interface on which a target excavation surface 60 is set; an operation sensor (operator operation sensor) 52 that senses data about operation of the operation levers 22 and 23 operated by an operator; the posture sensor (excavator posture sensor) 53 including the swing angle sensor 17 and the angle sensors 30 to 33; a work area setting device 54 which is an interface for setting a work area 62 (work area boundary 61); two GNSS antennas 55 for receiving satellite signals used for positioning of the upper swing structure 12; a notification device 46 that notifies the operator of various types of data including the states of excavation assistance control and deviation prevention control; and the solenoid proportional valves 47 that output pilot pressures for controlling the flow control valves 15.

(Controller 40)

The controller 40 (1) singly uses the excavation assistance control to control the front work implement 1A in some cases, (2) singly uses the deviation prevention control to control the front work implement 1A in some cases, and (3) uses both the excavation assistance control and the deviation prevention control to control the front work implement 1A in some cases. Among them, in the cases (3) in which the controller 40 uses both the excavation assistance control and the deviation prevention control to control the front work implement 1A, the controller 40 controls the front work implement 1A such that the operation direction of the bucket 10 approximates to the operation direction of the bucket 10 when the front work implement 1A is controlled by using only the excavation assistance control (i.e. in the cases (1)).

For the "excavation assistance control," target velocities related to at least two front implement members in the plurality of front implement members 8, 9, and 10 are computed on the basis of postural data obtained by the posture sensor 53 and operation data obtained by the operation sensor 52 such that the bucket 10 positioned at the tip of the work implement 1A moves along a predetermined target excavation surface 60 (see FIG. 5), and the at least two front implement members, that is, the front work implement 1A, are controlled on the basis of the computed target velocities.

For the "deviation prevention control," a limited velocity related to a front implement member (subject front implement member) which is included in the plurality of front implement members 8, 9, and 10, and is likely to deviate the front work implement 1A from a predetermined work area 62 (work area boundary 61 (see FIG. 6)) is computed on the basis of postural data obtained by the posture sensor 53, and control is performed such that the velocity of the front implement member which is likely to cause the deviation does not exceed the computed limited velocity to thereby prevent the deviation of the front work implement 1A from the work area 62.

Note that a "target velocity related to a front implement member" includes a target velocity of the front implement member itself, and a target velocity of a hydraulic cylinder (actuator) that drives the front implement member. Similarly, a "limited velocity related to a front implement member" includes a limited velocity of the front implement member itself, and a limited velocity of a hydraulic cylinder (actuator) that drives the front implement member.

The controller 40, by programs stored on a storage device (e.g. a hard disk drive or a flash memory) in the controller 40 being executed by a processing device (e.g. a CPU), functions as a target excavation surface computing section 74, an operator-operation-velocity estimating section 73, an excavator posture computing section 72, a work area computing section 75, an excavation assistance demanded velocity calculating section 76, a deviation prevention demanded velocity calculating section 77, a notification control section 78, and an actuator control section 79.

(Target Excavation Surface Computing Section 74)

Figure 3:
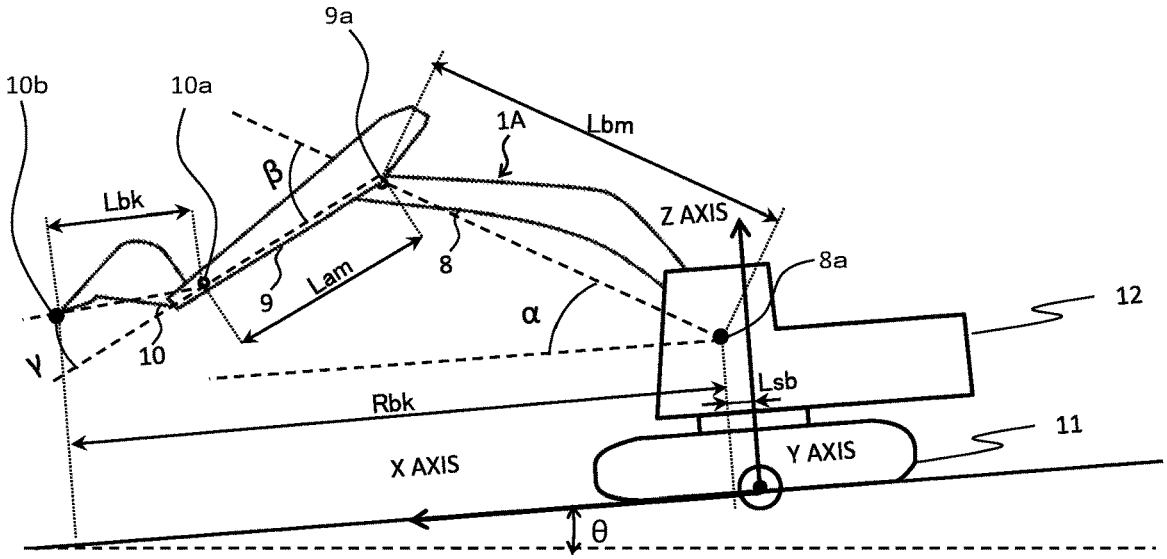
FIG. 3 is a figure depicting a coordinate system (excavator reference coordinate system) of the hydraulic excavator.

The target excavation surface computing section 74 measures the position and direction of the upper swing structure (machine body) 12 on the basis of satellite signals received at the two GNSS antennas 55, computes the target excavation surface 60 on the basis of a result of the measurement and data from the target excavation surface setting device 51, and executes a computation of converting the computed positional data about the target excavation surface 60 into positional data in an excavator reference coordinate system depicted in FIG. 3. Note that a coordinate system before the conversion is a global coordinate system (geographic coordinate system) or a site reference coordinate system. Note that the direction of the upper swing structure 12 may be computed by using the direction of the upper swing structure 12 measured at a certain time and a sensing value of the swing angle sensor 17.

(Operator-Operation-Velocity Estimating Section 73)

The operator-operation-velocity estimating section 73 estimates velocities (operator operation velocities) of the hydraulic actuators 5, 6, and 7, according to operator operation, by using a table of a correlation between operation amounts retained in the storage device of the controller 40 in advance, and a velocity (actuator velocity) of each of the hydraulic actuators 5, 6, and 7, on the basis of operator operation amounts of the operation levers 22*a* and 22*b* sensed by the operation sensor 52. In the present embodiment, furthermore, the computed velocities of the hydraulic actuators 5, 6, and 7 are converted into velocities (angular velocities) of the front implement members 8, 9, and 10 by using postural data about the excavator 1 computed by the excavator posture computing section 72 (mentioned below). Note that temporal changes in the angles may be computed from sensing values of the angle sensors 30 to 32, and velocities of the front implement members 8, 9, and 10 may be calculated on the basis of the computed temporal changes.

(Excavator Posture Computing Section 72)

The excavator posture computing section 72 computes a swing angle of the upper swing structure 12 in the excavator reference coordinate system from a sensing value of the swing angle sensor 17. In addition, the excavator posture computing section 72 computes the posture of the front work implement 1A (front implement members 8, 9, and 10) in the excavator reference coordinate system from sensing values of the boom angle sensor 30, the arm angle sensor 31, and the bucket angle sensor 32. The posture of the hydraulic excavator 1 can be defined on the excavator reference coordinate system (local coordinate system) in FIG. 3. The excavator reference coordinate system in FIG. 3 has its origin at a point which is on the swing center axis, and at which the lower travel structure 11 contacts the ground. The X axis of the excavator reference coordinate system is a direction along which the advancing direction of the lower travel structure 11 advancing straight and the operation plane of the front work implement 1A become parallel to each other, and along which the operation direction of the extending direction of the front work implement 1A and the operation direction of the lower travel structure 11 advancing forward coincide with each other. The Z axis is fixed at the lower surface of the lower travel structure 11 (a ground-contacting surface on which the lower travel structure 11 touches the ground), and the Y axis is determined to form a right-handed coordinate system with the Z axis at the swing center of the upper swing structure 12. In addition, the swing angle of the upper swing structure 12 becomes 0 degrees in a state in which the front work implement 1A is parallel to the X axis. The rotation angle of the boom 8 relative to the X axis is defined as a boom angle $\alpha$, the rotation angle of the arm 9 relative to the boom 8 is defined as an arm angle $\beta$, the rotation angle of the claw tip of the bucket 10 relative to the arm 9 is defined as a bucket angle $\gamma$, and the swing angle of the upper swing structure 12 relative to the lower travel structure 11 is defined as a swing angle $\delta$. The boom angle $\alpha$ is sensed by the boom angle sensor 30, the arm angle $\beta$ is sensed by the arm angle sensor 31, the bucket angle γ is sensed by the bucket angle sensor 32, and the swing angle δ is sensed by the swing angle sensor 34. By using these types of angle data, and dimensional data Lbm, Lam, and Lbk (see FIG. 3) about the front implement members 8, 9, and 10, the posture and position of each section (including the front implement members 8, 9, and 10) of the hydraulic excavator 1 in the excavator reference coordinate system can be computed. In addition, the inclination angle θ of the body 1B relative to the horizontal plane (reference plane) orthogonal to the direction of gravity can be sensed by the body inclination angle sensor 33. Note that, in another possible configuration, the controller 40 may be connected to the GNSS antennas 55, and the positions and directions of the target excavation surface 60, the work area 62, and the excavator 1 in the global coordinate system may be calculated to perform control.

(Work Area Computing Section 75)

The work area computing section 75 executes a computation of converting positional data about the work area boundary 61 (work area 62) that an operator can set as desired into positional data in the excavator reference coordinate system, on the basis of data from the work area setting device 54. The work area boundary 61 (work area 62) may be defined in the global coordinate system or the site reference coordinate system.

(Excavation Assistance Control)

Figure 5:
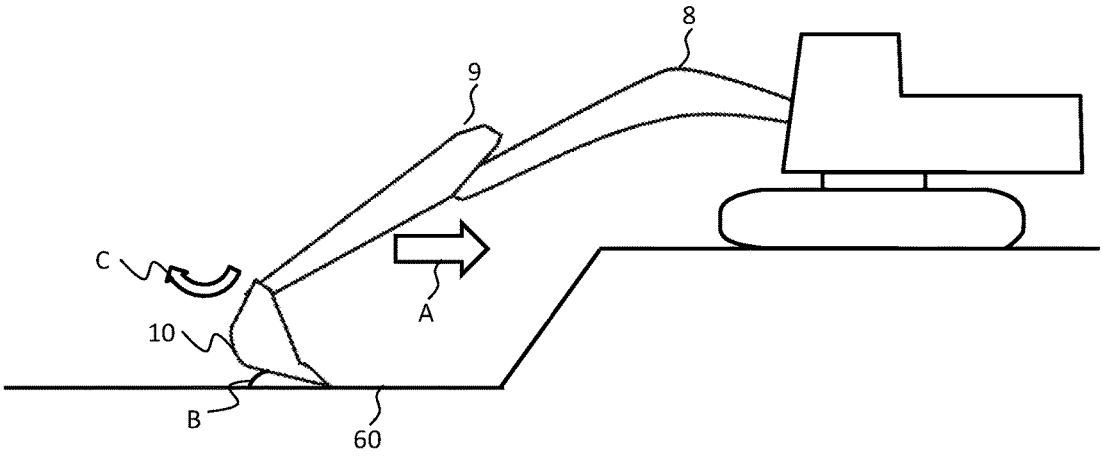
FIG. 5 is a figure depicting an example of horizontal excavation operation according to excavation assistance control.

Here, an example of horizontal excavation operation according to the excavation assistance control is depicted in FIG. 5. When an operator operates the operation levers 22 to perform horizontal excavation by pulling operation of the arm 9 in the direction of arrow A, a boom raising command is output as appropriate from the controller 40 such that the tip of the bucket 10 does not enter the space below the target excavation surface 60, and the solenoid proportional valve 47*e* is controlled such that raising operation of the boom 8 is performed automatically. In addition, the solenoid proportional valve 47*c* is controlled to perform pulling operation of the arm 9 such that an excavation velocity, which is a velocity of the tip of the bucket 10 demanded by the operator, or excavation precision, which is positional precision of the tip of the bucket 10, is realized. At this time, for enhancement of the excavation precision, the velocity of the arm 9 may be decelerated as necessary. In addition, the solenoid proportional valve 47*h* may be controlled such that the bucket 10 is automatically pivoted as appropriate in the direction of arrow C (dumping direction), according to the pulling operation of the arm 9, such that an angle B of the backside of the bucket 10 relative to the target excavation surface 60 becomes a constant value and levelling work becomes easy. In this manner, the excavation assistance control is control in which the hydraulic cylinders 5, 6, and 7 are controlled automatically or semi-automatically in response to operation of the front work implement 1A operated by the operator, and front implement members like the boom 8, the arm 9, and the bucket 10 are operated to attain the desired excavation profile (target excavation surface 60).

(Deviation Prevention Control)

In the deviation prevention control, when operation of the front work implement 1A and the upper swing structure 12 are instructed by using the operation devices 22, the operation of the hydraulic cylinders 5, 6, and 7 is decelerated or stopped to prevent deviation from the work area 62 on the basis of the predetermined work area boundary 61, the position of each section of the excavator, and operation data about the operation devices 22.

Figure 6:
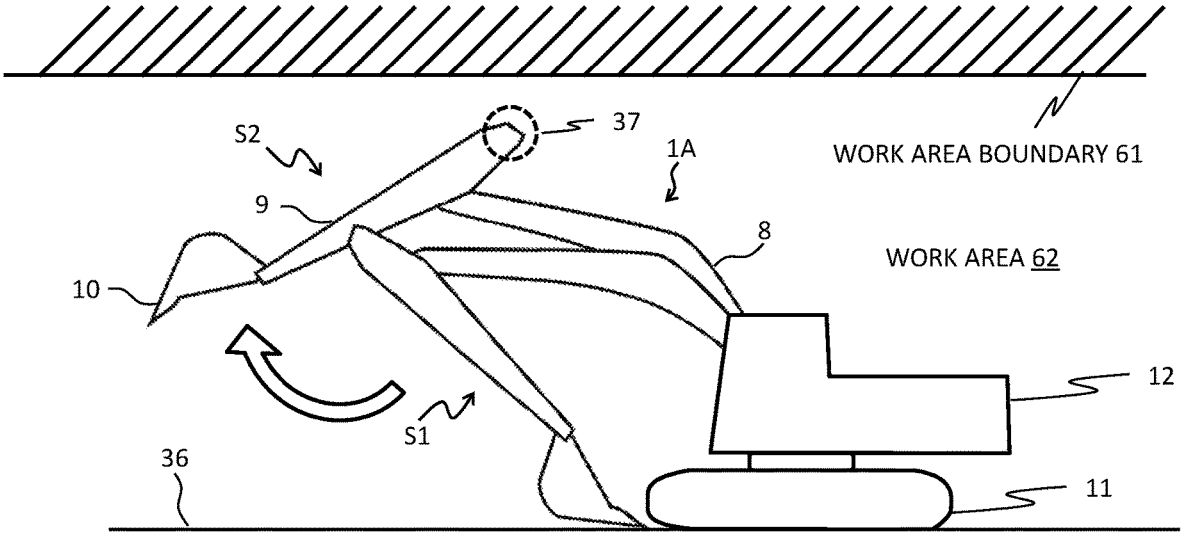
FIG. 6 is a figure depicting an example of prevention of deviation from a work area by deviation prevention control.

Here, an example of limitation of actuator operation according to the deviation prevention control is depicted in FIG. 6. FIG. 6 depicts state S1 and state S2 in one cycle of repeatedly-performed excavation work. In state S1, excavation work has ended, and the front work implement 1A is folded. In state S2, reaching work is being performed for next excavation work. When the state transitions from state S1 to state S2, an operator implements raising operation of the boom 8 in order to prevent a contact between the bucket 10 and the target excavation surface 60, but when the raising operation of the boom 8 is excessive, there is a possibility that, for example, a rear end section 37 of the arm 9 goes beyond the work area boundary 61, and deviates from the work area 62. In view of this, by the deviation prevention control, a command for decelerating the raising operation of the boom 8 (i.e. extending operation of the boom cylinder 5) is computed in order to prevent deviation of the rear end section 37 of the arm 9 from the work area 62 when the raising operation of the boom 8 is excessive in a situation like the one depicted in FIG. 6 where the state transitions from state S1 to state S2. In this manner, the deviation prevention control is control in which an actuator is decelerated or stopped in response to operation performed by the operator, and deviation from the work area 62 is prevented.

(Excavation Assistance Demanded Velocity Calculating Section 76)

Returning to FIG. 4, the excavation assistance demanded velocity calculating section (target velocity calculating section) 76 computes excavation assistance demanded velocities, which are target velocities related to at least two front implement members (e.g. the arm 9 and the boom 8) in the three front implement members 8, 9, and 10, such that the bucket 10 operates along the predetermined target excavation surface 60 when there is operation of an operation lever by the operator (e.g. operation of the arm 9). For example, the excavation assistance demanded velocity calculating section 76 computes the excavation assistance demanded velocities (target velocities) on the basis of postural data about the front work implement 1A computed from a sensing value of the posture sensor 53, operation data (operation amounts) about the operation levers 22 computed from a sensing value of the operation sensor 52, positional data about the target excavation surface 60 computed at the target excavation surface computing section 74, and positional data about the upper swing structure 12 computed from satellite signals received by the GNSS antennas 55.

(Deviation Prevention Demanded Velocity Calculating Section 77)

The deviation prevention demanded velocity calculating section (limited velocity calculating section) 77 computes a deviation prevention demanded velocity, which is a limited velocity related to a front implement member that is included in the plurality of three front implement members 8, 9, and 10 and that is likely to deviate from the work area 62, such that the front work implement 1A does not go beyond the work area boundary 61 and does not deviate from the predetermined work area 62 (i.e. such that entry into an entry prohibited area is prevented). For example, the deviation prevention demanded velocity calculating section 77 computes the deviation prevention demanded velocity (limited velocity) on the basis of positional data about the work area boundary 61 computed at the work area computing section 75, postural data about the front work implement 1A computed from a sensing value of the posture sensor 53, an operator operation velocity computed at the operator-operation-velocity estimating section 73, and excavation assistance demanded velocities computed at the excavation assistance demanded velocity calculating section 76. The deviation prevention demanded velocity becomes closer to zero as the distance between the front work implement 1A and the work area boundary 61 becomes closer to zero. The deviation prevention demanded velocity can be a limited velocity of an excavation assistance demanded velocity (target velocity) computed at the excavation assistance demanded velocity calculating section 76 during execution of the excavation assistance control. On the other hand, when there is not intervention by the excavation assistance control or when the excavation assistance control is disabled, the deviation prevention demanded velocity can be a limited velocity of the operator operation velocity computed at the operator-operation-velocity estimating section 73. When an excavation assistance demanded velocity or an operator operation velocity of a front implement member exceeds the deviation prevention demanded velocity, the velocity related to the front implement member is limited to the deviation prevention demanded velocity, and the front implement member is forcibly decelerated or stopped. On the contrary, when an excavation assistance demanded velocity or an operator operation velocity of a front implement member is equal to or lower than the deviation prevention demanded velocity, the velocity related to the front implement member is not limited, and the front member is controlled according to the excavation assistance demanded velocity or the operator operation velocity.

Figure 13:
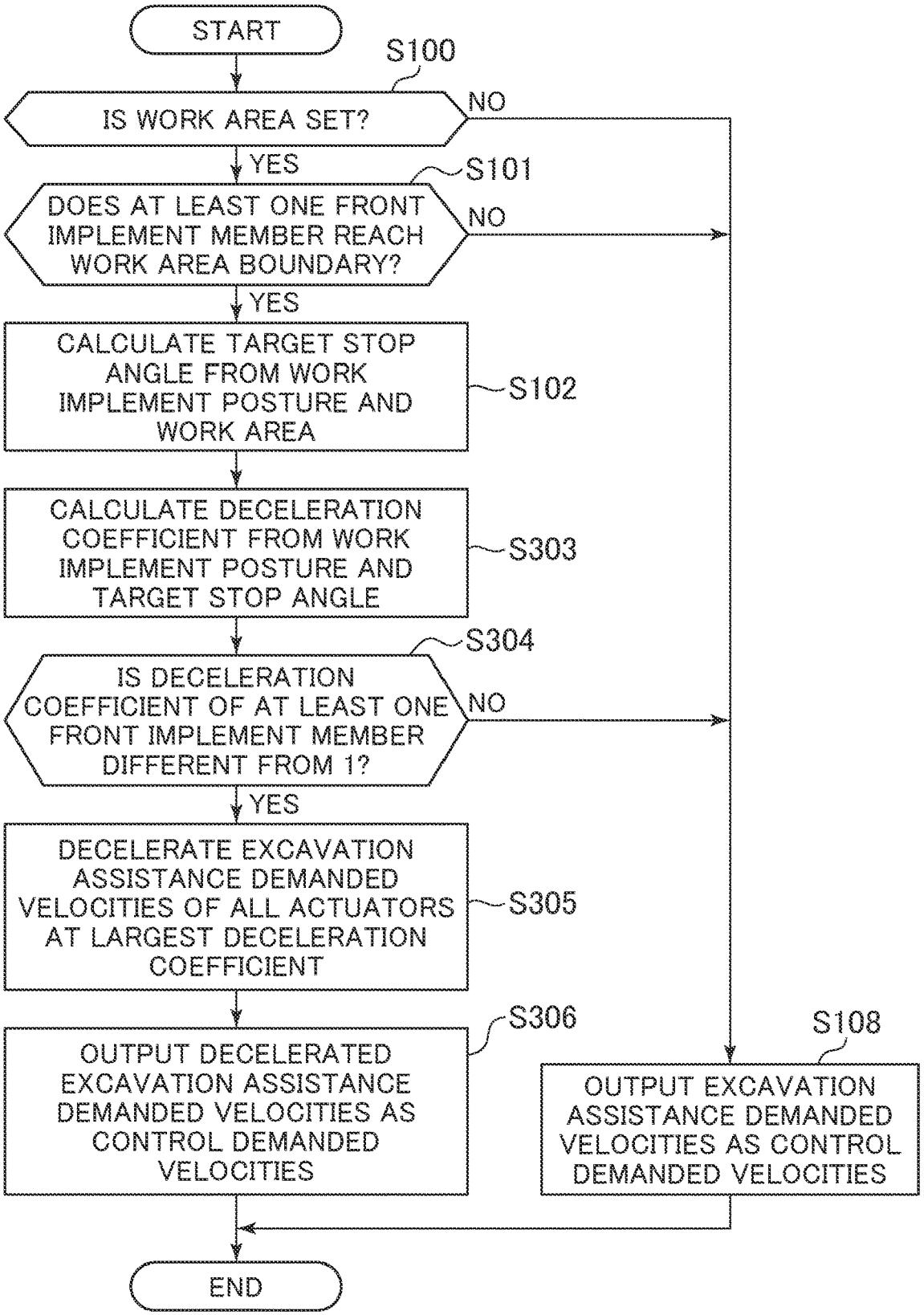
FIG. 13 is a figure depicting an example of a flowchart of control according to the deviation prevention control.

Furthermore, the deviation prevention demanded velocity calculating section 77 according to the present embodiment decides whether there is a front implement member (referred to as a "subject front implement member" in some cases) that is included in at least two front implement members for which excavation assistance demanded velocities (target velocities) have been computed at the excavation assistance demanded velocity calculating section 76, and for which a deviation prevention demanded velocity (limited velocity) has been computed at the deviation prevention demanded velocity calculating section 77, and whether or not an excavation assistance demanded velocity (target velocity) related to the subject front implement member exceeds the deviation prevention demanded velocity (limited velocity) related to the subject front implement member. Then, when the excavation assistance demanded velocity (target velocity) related to the subject front implement member exceeds the deviation prevention demanded velocity (limited velocity), a deviation prevention demanded velocity related to the remaining front implement member which is included in the at least two front implement members for which the excavation assistance demanded velocities (target velocities) have been computed at the excavation assistance demanded velocity calculating section 76, and is not the subject front implement member is computed on the basis of the deviation prevention demanded velocity related to the subject front implement member. It should be noted however that in the computation of the deviation prevention demanded velocity of the remaining front implement member, the deviation prevention demanded velocity of the remaining front implement member is calculated such that the operation direction of the bucket 10 (the direction of a velocity vector of the bucket tip) defined by the deviation prevention demanded velocity of the subject front implement member and the deviation prevention demanded velocity of the remaining front implement member approximates to or matches the operation direction of the bucket defined by the excavation assistance demanded velocities (target velocities) of the at least two front implement members (a specific example of the computation is mentioned below by using FIG. 11 and FIG. 13). Then, the deviation prevention demanded velocities of the subject front implement member and the remaining front implement member are output to the actuator control section 79. Thereby, even if the front work implement 1A approaches the work area boundary 61, and the deviation prevention control intervenes, significant changes in the operation direction of the bucket 10 defined by the excavation assistance control are suppressed.

(Notification Control Section 78)

The notification control section 78 outputs a command signal to the notification device 46 such that the notification device 46 outputs work assistance information. For example, the work assistance information output by the notification device 46 includes: information about presence or absence of deceleration of the front implement members 8, 9, and 10 according to the deviation prevention control; identification data (e.g. a name or an image) about a front implement member decelerated by the control; the activation status of the deviation prevention control and the excavation assistance control; a positional relation between the bucket 10 and the target excavation surface 60; and a positional relation between the work implement 1A and the work area 62 (work area boundary 61). For example, examples of the notification device 46 include a monitor, a speaker, and a warning light, and the notification device 46 can be configured with any one of these or with a combination of a plurality of these.

(Actuator Control Section 79)

The actuator control section 79 outputs, to the solenoid proportional valves, command signals necessary for controlling operation of the front implement members 8, 9, and 10 according to velocities (referred to as "control demanded velocities" in some cases) output from the deviation prevention demanded velocity calculating section 77. Examples of the control demanded velocity include operator operation velocities, excavation assistance demanded velocities before correction, deviation prevention demanded velocities, and excavation assistance demanded velocities after correction.

(Details of Process at Excavation Assistance Demanded Velocity Calculating Section 76)

Figure 9:
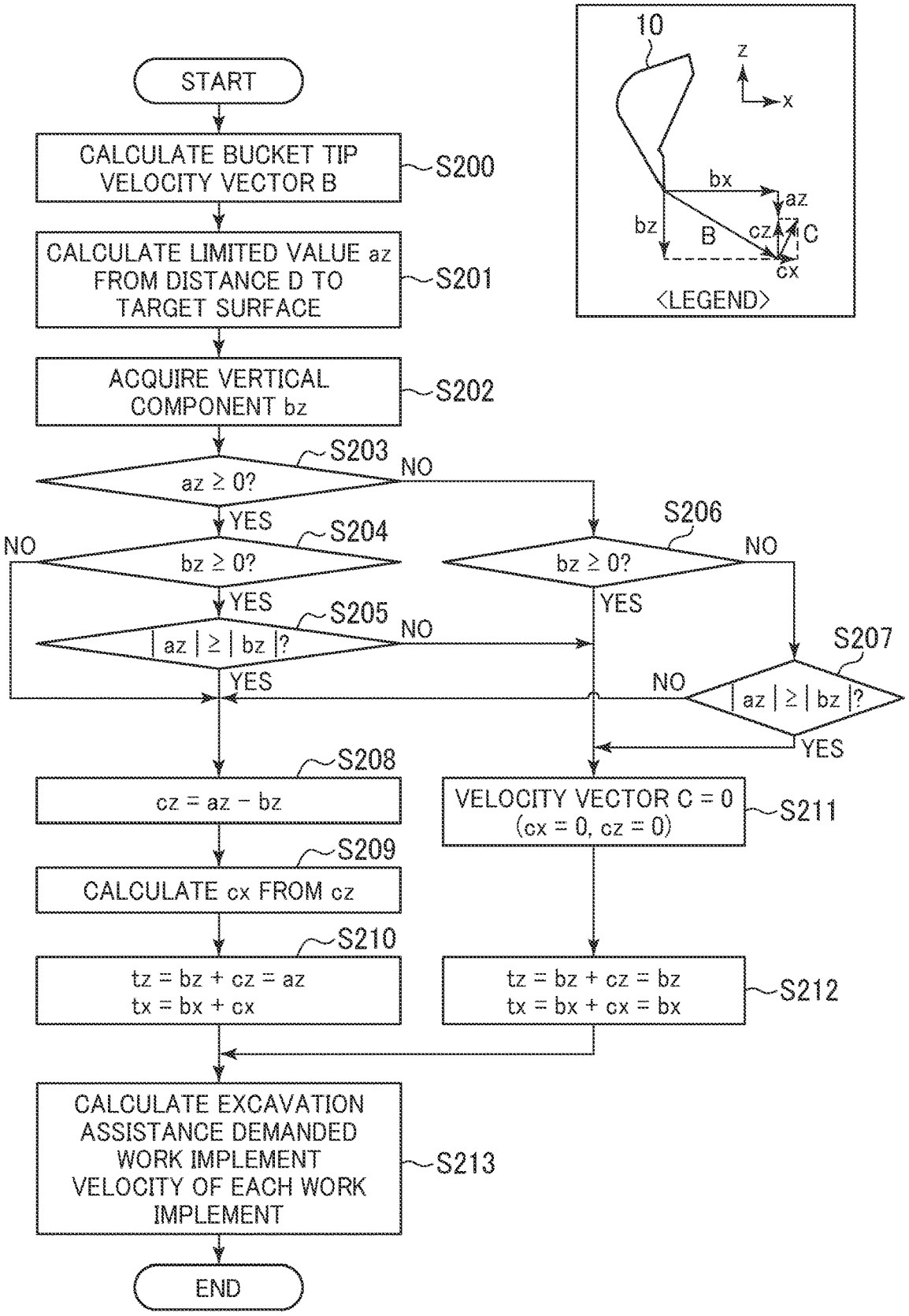
FIG. 9 is a figure depicting an example of a flowchart of control according to the excavation assistance control.
Figure 10:
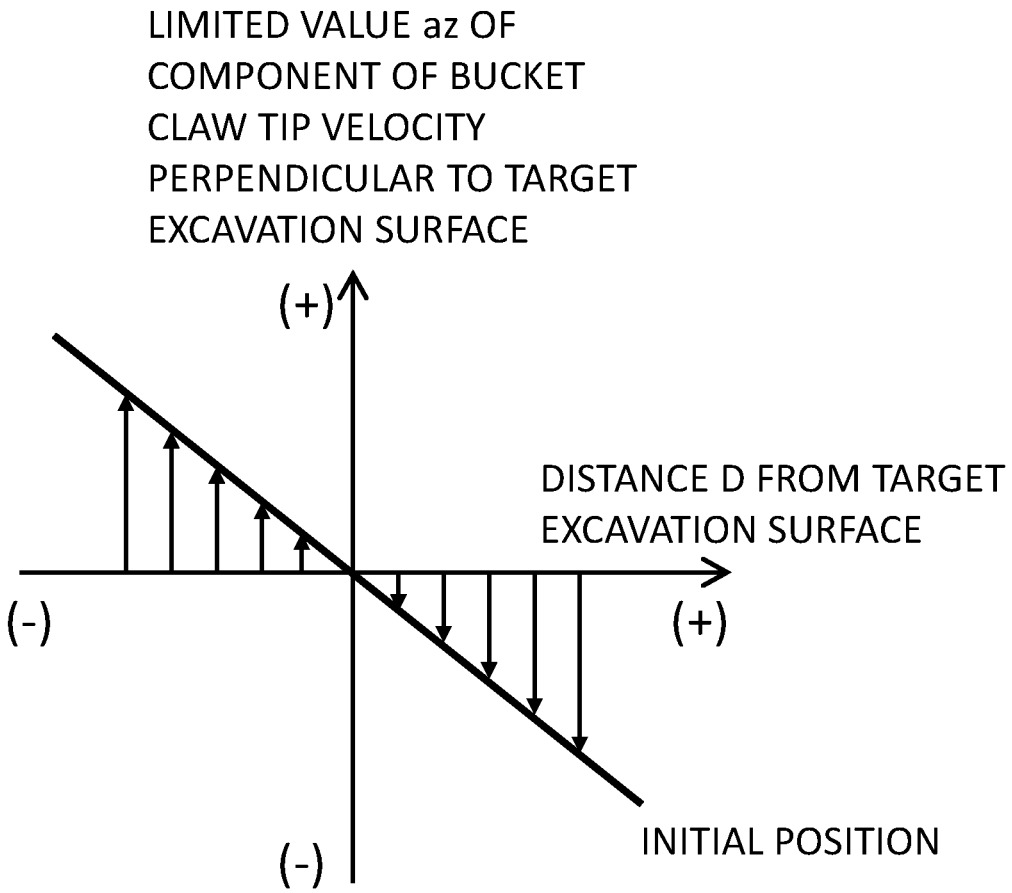
FIG. 10 is an auxiliary figure of the flowchart.

Here, an example in which the front work implement 1A is controlled such that the tip (control point) of the bucket 10 is positioned on or above the target excavation surface 60 by automatically adding operation of raising the boom 8 to operation of the arm 9 operated by an operator is explained as an example of the excavation assistance control by using FIG. 9 and FIG. 10.

FIG. 9 is a flowchart of a process executed by the excavation assistance demanded velocity calculating section 76 in the controller 40. In the case considered here, as depicted in an upper right legend in FIG. 9, it is supposed that a velocity vector B is generated at the tip of the bucket 10 due to arm operation by the operator, and boom raising operation that generates a velocity vector C is automatically added to the arm operation that generates the velocity vector B, such that a component (vertical component) of a velocity vector actually generated at the tip of the bucket 10, the component being perpendicular to the target excavation surface 60, is limited to a limited value az defined in FIG. 10.

At Step S200, the excavation assistance demanded velocity calculating section 76 computes the velocity vector B of the tip of the bucket 10 generated by the operator operation on the basis of operation velocity data (velocity data (angular velocity data) about the front implement members 8, 9, and 10 estimated from the operator operation) about the front work implement 1A from the operator-operation-velocity estimating section 73, and postural data about the front work implement 1A from the excavator posture computing section 72.

At Step S201, the excavation assistance demanded velocity calculating section 76 calculates a distance D from the tip of the bucket 10 to the target excavation surface 60 from the position (coordinates) of the tip of the bucket 10 computed at the excavator posture computing section 72 and a distance of a straight line including the target excavation surface 60 from the target excavation surface computing section 74. Then, on the basis of the distance D and the graph in FIG. 10, the limited value az of the component of the velocity vector of the tip of the bucket 10, the component being perpendicular to the target excavation surface 60, is calculated.

At Step S202, the excavation assistance demanded velocity calculating section 76 acquires a component bz of the velocity vector B of the tip of the bucket 10 according to the operator operation calculated at Step S200, the component bz being perpendicular to the target excavation surface 60.

At S203, the excavation assistance demanded velocity calculating section 76 decides whether or not the limited value az calculated at S201 is equal to or larger than 0. Note that xz coordinates are set as depicted in the upper right portion in FIG. 9. In the xz coordinates, the rightward direction in the figure, which is parallel to the target excavation surface 60, is defined as the positive direction of the x axis, and the upward direction, in the figure, perpendicular to the target excavation surface 60 is defined as the positive direction of the z axis. In the legend in FIG. 9, the vertical component bz and the limited value az point to the negative direction, and a horizontal component bx, a horizontal component cx, and a vertical component cz point to the positive directions. In addition, the legend in FIG. 9 depicts a situation where the target excavation surface is located below the tip of the bucket 10. Then, on the basis of FIG. 10, a case where the limited value az is 0 is a case where the distance D is 0, that is, the tip of the bucket 10 is positioned on the target excavation surface 60, a case where the limited value az is a positive value is a case where the distance D is a negative distance, that is, the tip of the bucket 10 is positioned below the target excavation surface 60, and a case where the limited value az is a negative value is a case where the distance D is a positive value, that is, the tip of the bucket 10 is positioned above the target excavation surface 60. When it is decided at S203 that the limited value az is equal to or larger than 0 (i.e. a case where the tip of the bucket 10 is positioned on or below the target excavation surface 60), the process proceeds to S204, and when the limited value az is smaller than 0, the process proceeds to S206.

At S204, the excavation assistance demanded velocity calculating section 76 decides whether or not the vertical component bz of the velocity vector B of the tip of the bucket 10 according to the operator operation is equal to or larger than 0. When bz is a positive value, this represents that the vertical component bz of the velocity vector B points to the upward direction, and when bz is a negative value, this represent that the vertical component bz of the velocity vector B points to the downward direction. When it is decided at S204 that the vertical component bz is equal to or larger than 0 (i.e. a case where the vertical component bz points to the upward direction), the process proceeds to S205, and when the vertical component bz is smaller than 0, the process proceeds to S208.

At S205, the excavation assistance demanded velocity calculating section 76 compares the absolute values of the limited value az and the vertical component bz with each other, and when the absolute value of the limited value az is equal to or larger than the absolute value of the vertical component bz, the process proceeds to S208. On the other hand, when the absolute value of the limited value az is smaller than the absolute value of the vertical component by, the process proceeds to S211.

At S208, the excavation assistance demanded velocity calculating section 76 selects "cz=az−bz" as a formula for calculating the component cz of the velocity vector C of the tip of the bucket 10 that should be generated by operation of the boom 8 according to the excavation assistance control, the component cz being perpendicular to the target excavation surface 60, and calculates the vertical component cz on the basis of the formula, the limited value az calculated at S201, and the vertical component bz acquired at S202. Then, at Step S209, the velocity vector C that can output the calculated vertical component cz is calculated, and the horizontal component is set as cx.

At S210, the excavation assistance demanded velocity calculating section 76 calculates a target velocity vector T. If a component of the target velocity vector T, the component being perpendicular to the target excavation surface 60, is defined as tz, and a horizontal component of the target velocity vector T is tx, they can be represented by "tz=bz+cz, tx=bx+cx," respectively. Assigning these to the formula (cz=az−bz) in S208 gives "tz=az, tx=bx+cx" about the target velocity vector T after all. That is, the vertical component tz of the target velocity vector when the process has reached S210 is limited to the limited value az, and automatic boom raising according to the excavation assistance control is activated.

At S206, the excavation assistance demanded velocity calculating section 76 decides whether or not the vertical component bz of the velocity vector B of the claw tip according to the operator operation is equal to or larger than 0. When it is decided at S206 that the vertical component bz is equal to or larger than 0 (i.e. a case where the vertical component bz points to the upward direction), the process proceeds to S211, and when the vertical component bz is smaller than 0, the process proceeds to S207.

At S207, the excavation assistance demanded velocity calculating section 76 compares the absolute values of the limited value az and the vertical component bz with each other, and when the absolute value of the limited value az is equal to or larger than the absolute value of the vertical component bz, the process proceeds to S211. On the other hand, when the absolute value of the limited value az is smaller than the absolute value of the vertical component bz, the process proceeds to S208.

When the process has reached S211, the velocity vector C is set to zero because it is not necessary to operate the boom 8 by the excavation assistance control. In this case, the target velocity vector T calculated at Step S212 is "tz=bz, tx=bx" on the basis of the formula (tz=bz+cz, tx=bx+cx) used at S210, and matches the velocity vector B according to the operator operation.

At S213, the excavation assistance demanded velocity calculating section 76 computes excavation assistance demanded velocities of the front implement members 8, 9, and 10 on the basis of the target velocity vector T (tz, tx) determined at S210 or S212, and outputs them to the deviation prevention demanded velocity calculating section 77. In the present embodiment, it is supposed that the excavation assistance demanded velocities are computed for the boom 8 and the arm 9.

As a result of the processing above, when the vertical component of the velocity vector B exceeds the limited value az, boom operation to generate the velocity vector C is added automatically, and thereby the vertical component of the velocity vector of the tip of the bucket 10 is maintained at the limited value az. The limited value az is set such that it approaches zero as the tip of the bucket 10 approaches the target excavation surface 60, but because the horizontal component of the velocity vector of the tip of the bucket 10 is the sum of the horizontal components of the velocity vectors B and C and is not limited, the tip of the bucket 10 can be moved along the target excavation surface 60 on the target excavation surface 60.

(Details of Process at Deviation Prevention Demanded Velocity Calculating Section 77)

Figure 11:
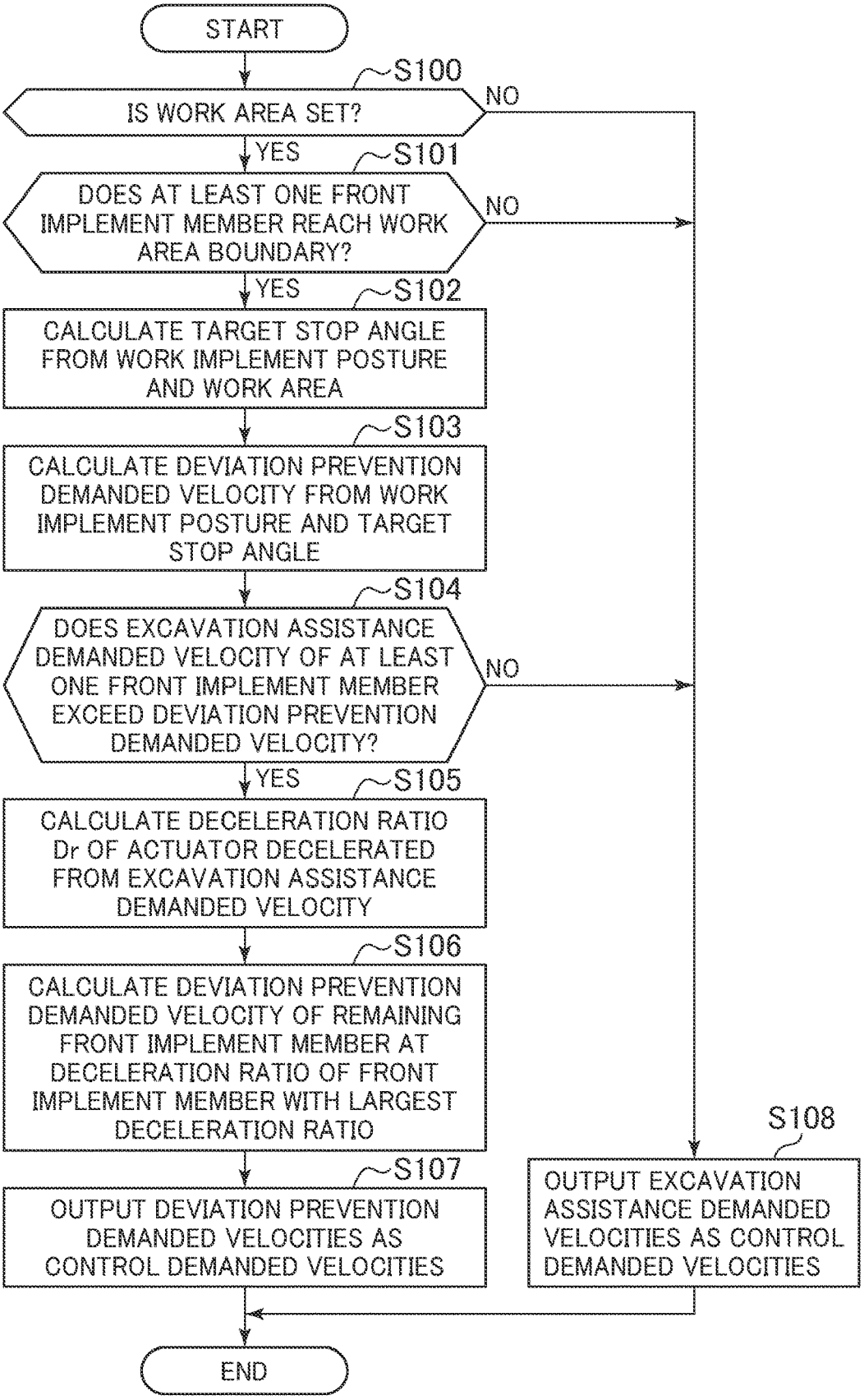
FIG. 11 is a figure depicting an example of a flowchart of control according to the deviation prevention control.

FIG. 11 is a flowchart of a process executed by the deviation prevention demanded velocity calculating section 77 in the controller 40. Note that Steps S105, S106, and S107 in processes at Steps S100 to S108 that are depicted are processes that are to be performed when the excavation assistance control and the deviation prevention control are executed simultaneously.

At Step S100, the deviation prevention demanded velocity calculating section 77 acquires data from the work area computing section 75, and determines whether or not the work area 62 (or the work area boundary 61) has been set. When it is determined that the work area 62 has been set, the process proceeds to Step S101, and when it is determined that the work area 62 has not been set, the process proceeds to Step S108.

At Step S101, the deviation prevention demanded velocity calculating section 77 determines whether or not there is a front implement member that is likely to deviate the front work implement 1A from the work area 62 when the front implement members 8, 9, and 10 are operated from the current posture. In the present embodiment, the aforementioned determination is made on the basis of whether or not the front work implement 1A reaches the work area boundary 61 when each of the boom 8, the arm 9, and the bucket 10 is operated singly to the limit of its movable range from the current posture. When it is determined that at least one front implement member in the three front implement members 8, 9, and 10 can deviate the front work implement 1A from the work area 62, the process proceeds to Step S102, and when it is determined that none of the front implement members 8, 9, and 10 deviates the front work implement 1A from the work area 62, the process proceeds to Step S108.

At Step S102, the deviation prevention demanded velocity calculating section 77, on the basis of the posture of the front work implement 1A and positional data about the work area boundary 61, calculates a target stop angle θt which is an angle to be formed when the front work implement 1A reaches the work area boundary 61 when each of the boom 8, the arm 9, and the bucket 10 is singly operated to the limit of its movable range from the current posture. The target stop angle θt is defined similarly to the pivot angles α, β, and γ of the front implement members 8, 0, and 10. A calculation of the target stop angle θt is mentioned in detail by using FIG. 12.

Figure 12:
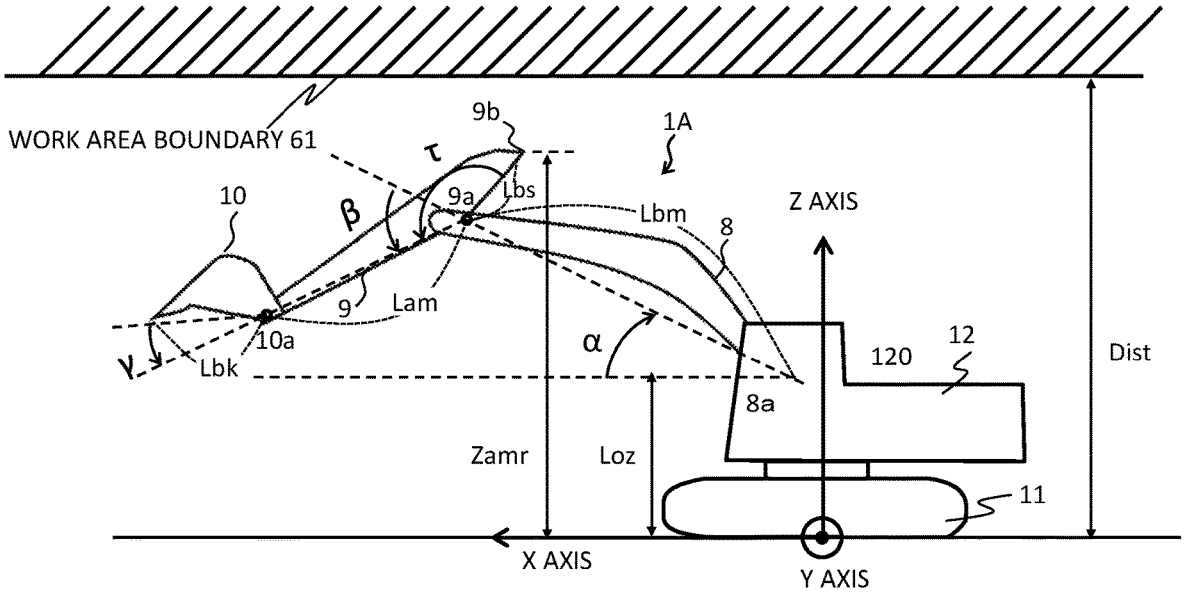
FIG. 12 is a figure depicting an example of a calculation of a stopped portion.

First, in FIG. 12, a position (height) Zamr of an arm rear end section 9*b* can be calculated according to the following Formula (1). It should be noted however that, as depicted in FIG. 12, Lbm is the distance between the boom pin 8*a* and the arm pin 9*a*, Lbs is the distance from the arm pin 9*a* to the arm rear end section 9*b*, and τ is geometric data (angle) related to the arm 9.

[Equation 1]

$$z_{amr}=-L_{bm}\sin\alpha-L_{bs}\sin(\alpha+\beta-\tau) \quad \text{Formula (1)}$$

By using the geometric data about the hydraulic excavator 1 including the front work implement 1A in this manner, it is possible to similarly calculate the positions of other portions of the front work implement 1A also. The calculation of a target stop angle θt is implemented for each of front implement members for which a result of the decision at Step S101 has been Yes, and the calculation of a target stop angle θt is not implemented for a front implement member for which a result of the decision is No.

Here, if the distance from the origin of the coordinate system of the excavator 1 to the upper work area boundary 61 is Dist, and the distance in the Z-axis direction from the origin of the coordinate system of the excavator 1 to the boom pin 8*a* is Loz, a target stop angle θtbm of the boom 8 when only the boom 8 operates from the current posture is represented by the following Formula (2). Note that A and B are values related to the R-alpha method of trigonometric functions.

[Equation 2]

$$\theta_{tbm}=\sin^{-1}\left(\frac{L_{oz}-Dist}{\sqrt{A^2+B^2}}\right)-C,\ C=a\tan2(B,A) \quad \text{Formula (2)}$$

At Step S103, the deviation prevention demanded velocity calculating section 77 calculates a deviation prevention demanded velocity ωa of a subject front implement member from the current posture of the front work implement 1A and the target stop angle θt computed at Step S102. The calculation of the deviation prevention demanded velocity ωa can be implemented as in the following Formula (3), for example. It should be noted however that ωa is the deviation prevention demanded velocity of the subject front implement member, da is a degree of deceleration of the subject front implement member, θt is the target stop angle of the subject front implement member, and θc is the current angle of the subject front implement member.

[Equation 3]

$$\omega_a=\sqrt{-2d_a(\theta_t-\theta_c)} \quad \text{Formula (3)}$$

The calculation of a deviation prevention demanded velocity ωa at Step S103 is implemented for each of the front implement members for which a result of the decision at Step S101 is Yes, and a deviation prevention demanded velocity ωa of the front implement member for which a result of the decision is No is set to an excavation assistance demanded velocity.

At Step S104, the deviation prevention demanded velocity calculating section 77 determines whether or not the excavation assistance demanded velocity of the front implement member (subject front implement member) for which the deviation prevention demanded velocity ωa has been calculated at Step S103 exceeds the deviation prevention demanded velocity ωa of the subject front implement member. When the excavation assistance demanded velocity exceeds the deviation prevention demanded velocity ωa, the excavation assistance demanded velocity is reduced to the deviation prevention demanded velocity, and when the excavation assistance demanded velocity does not exceed the deviation prevention demanded velocity ωa, velocity limitation of the excavation assistance demanded velocity is not performed. Here, when it is determined that the excavation assistance demanded velocity of at least one front implement member which is included in the at least two front implement members (here, the arm 9, and the boom 8) for which the excavation assistance demanded velocities have been computed exceeds its deviation prevention demanded velocity ωa, the process proceeds to Step S105. On the other hand, when it is determined that none of the excavation assistance demanded velocities exceed their deviation prevention demanded velocities ωa, the process proceeds to Step S108.

At Step S105, the deviation prevention demanded velocity calculating section 77, regarding the front implement member whose excavation assistance demanded velocity has been decided as exceeding the deviation prevention demanded velocity ωa at Step S104, calculates a deceleration ratio Dr of an actuator (hydraulic cylinder) to be decelerated from the excavation assistance demanded velocity. Here, if the excavation assistance demanded velocity is defined as ωmc, and the deviation prevention demanded velocity is defined as ωa, the deceleration ratio Dr can be calculated in the following manner. Note that the ratio (ωa/ωmc) of the deviation prevention demanded velocity ωa to the excavation assistance demanded velocity ωmc is referred to as a velocity ratio in some cases.

[Equation 4]

$$D_r = 1 - \frac{\omega_a}{\omega_{mc}} \qquad \text{Formula (4)}$$

According to Formula (4) described above, the velocity ratio (ωa/ωmc) becomes zero (smallest value), and the deceleration ratio Dr becomes 1 (largest value) when the deviation prevention demanded velocity ωa is zero at which the subject front implement member is decelerated most. Regarding the front implement member for which a deviation prevention demanded velocity ωa has not been computed, the deviation prevention demanded velocity ωa is set to the excavation assistance demanded velocity ωmc, and the velocity ratio (ωa/ωmc) becomes 1 (largest value), and the deceleration ratio Dr becomes zero (smallest value) in this case.

The calculation of a velocity ratio (ωa/ωmc) and a deceleration ratio Dr at Step S105 is implemented for all of the at least two front implement members (here, the boom 8, and the arm 9) for which the excavation assistance demanded velocities have been computed.

At Step S106, the deviation prevention demanded velocity calculating section 77 calculates again the deviation prevention demanded velocity ωa of a remaining front implement member, which is included in all of the front implement members for which the deceleration ratios Dr have been calculated at Step S105 and which is not the one having the largest deceleration ratio Dr, such that the deceleration ratio of the remaining front implement member matches the deceleration ratio (reference deceleration ratio) of the front implement member having the largest deceleration ratio Dr. Thereby, the operation direction of the bucket 10 defined by the deviation prevention demanded velocity ωa related to the subject front implement member and the deviation prevention demanded velocity ωa related to the remaining front implement member matches the operation direction of the bucket 10 defined by the excavation assistance demanded velocities ωmc related to the at least two front implement members for which the excavation assistance demanded velocities ωmc have been computed. For example, when a deviation prevention demanded velocity ωabm of the boom 8 becomes zero, that is, when the velocity ratio becomes zero and the deceleration ratio becomes 1, deviation prevention demanded velocities ωaam and ωabk of the arm 9 and the bucket 10 are corrected to zero as a result of the process at Step S106 even if the deceleration ratios Dr of the arm 9 and the bucket 10 computed at Step S105 are smaller than 1.

At Step S107, the deviation prevention demanded velocity calculating section 77 outputs, as the control demanded velocity of each front implement member, the deviation prevention demanded velocity ωa of each front implement member calculated at Step S106.

When the process has reached Step S108, the deviation prevention demanded velocity calculating section 77 outputs the excavation assistance demanded velocities as the control demanded velocities.

The control demanded velocities output by the deviation prevention demanded velocity calculating section 77 at Step S107 or S108 are input to the actuator control section 79 depicted in FIG. 4. The actuator control section 79 converts the control demanded velocities which are angular velocities of the front implement members into control demanded actuator velocities which are velocities of actuators corresponding to the front implement members. Then, the actuator control section 79 outputs command values to realize the control demanded actuator velocities to corresponding solenoid proportional valves 47. Thereby, the solenoid proportional valves 47 operate to apply pilot pressures to flow control valves 15, applicable hydraulic cylinders operate according to the control demanded actuator velocities, and the excavation assistance control and the deviation prevention control are realized.

Note that when MC (the excavation assistance control and the deviation prevention control) is not enabled in each step depicted in FIG. 11, each step may be executed by reading excavation assistance demanded velocities as meaning operator operation velocities.

In addition, whereas the deceleration ratio Dr is used to compute the deviation prevention demanded velocity of the remaining front implement member at Steps S105 and S106 in the example in FIG. 11, the velocity ratio (ωa/ωmc) may be used. In this case, the velocity ratio (ωa/ωmc) of the subject front implement member is used as the reference velocity ratio, and the deviation prevention velocity related to the remaining front implement member, which is included in the at least two front implement members for which the excavation assistance demanded velocities have been computed and which is not the subject front implement member, is computed such that the velocity ratio (ωa/ωmc) of the remaining front implement member matches the reference velocity ratio. Note that when there are two or more subject front implement members, a velocity ratio (ωa/ωmc) of each of the two or more subject front implement members may be calculated, and the smallest velocity ratio of the plurality of calculated velocity ratios (ωa/ωmc) may be used as the reference velocity ratio to compute the deviation prevention demanded velocity of the remaining front implement member.

(Operation)

Next, a situation where the controller 40 controls the front work implement 1A by using both the excavation assistance control and the deviation prevention control is explained.

Figure 7:
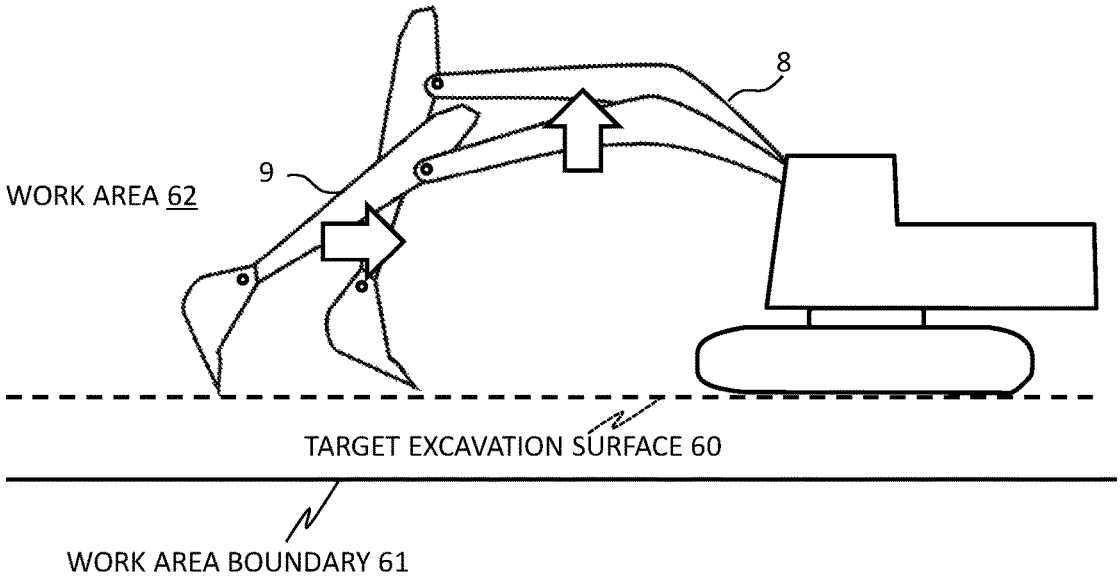
FIG. 7 is a figure depicting excavation operation in a situation where a target excavation surface and a work area boundary are proximate to each other.

First, in the example in FIG. 7, the work area boundary 61 is set below the target excavation surface 60. If an operator inputs arm crowding operation to the operation levers 22 in the situation in FIG. 7, by the excavation assistance control of the controller 40, an excavation assistance demanded velocity of boom raising (an excavation assistance demanded velocity of the boom 8) for moving the bucket tip along the target excavation surface 60 is calculated for an operator operation velocity of the arm 9 (an excavation assistance demanded velocity of the arm 9) computed from the arm crowding operation performed by the operator (i.e. excavation assistance demanded velocities of the arm 9 and the boom 8 are computed). On the other hand, it is supposed that because the front work implement 1A has approached the work area boundary 61 due to the arm crowding operation by the operator, by the deviation prevention control of the controller 40, a deviation prevention demanded velocity lower than the operator operation velocity of the arm 9 (the excavation assistance demanded velocity of the arm 9) has been computed (i.e. a deviation prevention demanded velocity of the arm 9 in the arm 9 and the boom 8 for which the excavation assistance demanded velocities have been computed has been computed).

In the situation described above, in conventional technologies, whereas arm crowding is reduced in velocity from the excavation assistance demanded velocity (operator operation velocity) to the deviation prevention demanded velocity, boom raising is not reduced, but is kept at the excavation assistance demanded velocity. Accordingly, the boom raising becomes excessive relative to the arm crowding, and there is a fear that the bucket tip floats above from the target excavation surface 60, and excavation along the target excavation surface 60 becomes impossible.

However, the controller 40 (deviation prevention demanded velocity calculating section 77) according to the present embodiment computes also a deviation prevention demanded velocity of the boom raising according to the calculated deviation prevention demanded velocity of the arm crowding such that the direction of the velocity vector of the bucket tip does not change even if the magnitude of the velocity vector is reduced by execution of the deviation prevention control. Because of this, even if the excavation assistance control and the deviation prevention control function simultaneously, the bucket tip moves along the target excavation surface 60, and thus excavation along the target excavation surface 60 becomes possible.

Figure 8:
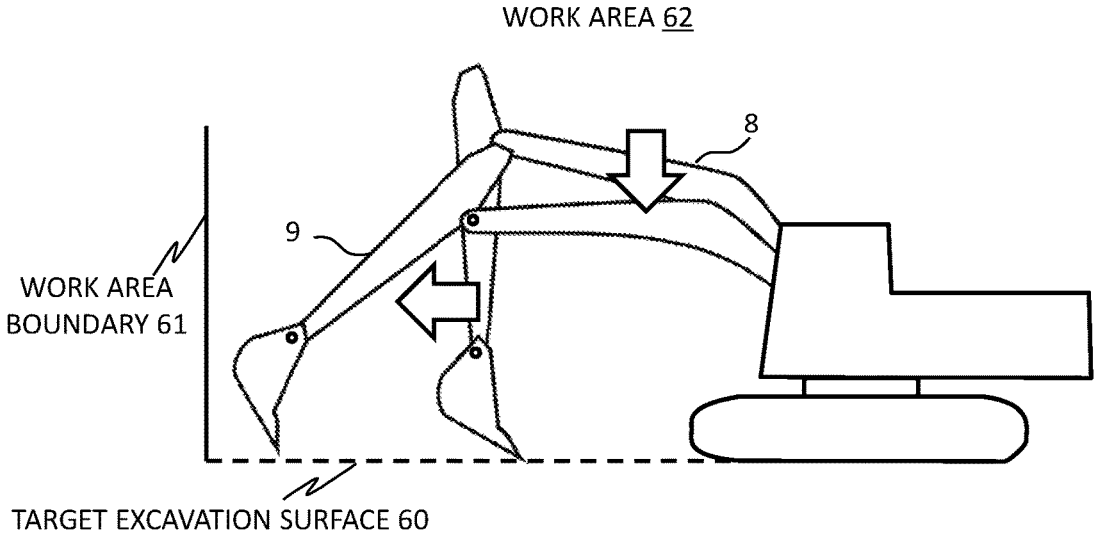
FIG. 8 is a figure depicting excavation operation in a situation where a target excavation surface and a work area boundary are proximate to each other.

Next, in the example in FIG. 8, the target excavation surface 60 is set below the excavator 1, and the work area boundary 61 is set in front of the excavator 1. If an operator inputs arm dumping operation (pressing operation) to the operation levers 22 in the situation in FIG. 8, by the excavation assistance control of the controller 40, an excavation assistance demanded velocity of boom lowering (an excavation assistance demanded velocity of the boom 8) for moving the bucket tip along the target excavation surface 60 is calculated for an operator operation velocity of the arm 9 (an excavation assistance demanded velocity of the arm 9) computed from the arm dumping operation performed by the operator (i.e. excavation assistance demanded velocities of the arm 9 and the boom 8 are computed). On the other hand, it is supposed that because the front work implement 1A has approached the work area boundary 61 due to the arm dumping operation by the operator, by the deviation prevention control of the controller 40, a deviation prevention demanded velocity lower than the operator operation velocity of the arm 9 (the excavation assistance demanded velocity of the arm 9) has been computed (i.e. a deviation prevention demanded velocity of the arm 9 in the arm 9 and the boom 8 for which the excavation assistance demanded velocities have been computed has been computed).

In this situation also, in conventional technologies, whereas arm dumping is reduced in velocity from the excavation assistance demanded velocity (operator operation velocity) to the deviation prevention demanded velocity, boom lowering is not reduced, but is kept at the excavation assistance demanded velocity. Accordingly, the boom lowering becomes excessive relative to the arm dumping, and there is a fear that the bucket tip goes down below the target excavation surface 60, and excavation along the target excavation surface 60 becomes impossible.

However, the controller 40 (deviation prevention demanded velocity calculating section 77) according to the present embodiment computes also a deviation prevention demanded velocity of the boom lowering according to the calculated deviation prevention demanded velocity of the arm dumping such that the direction of the velocity vector of the bucket tip does not change even if the magnitude of the velocity vector is reduced by execution of the deviation prevention control. Because of this, even if the excavation assistance control and the deviation prevention control operate simultaneously, the bucket tip moves along the target excavation surface 60, and thus excavation along the target excavation surface 60 becomes possible.

(Summary)

The hydraulic excavator 1 configured in the manner described above can realize the deviation prevention control by which when there is a possibility that the front work implement 1A deviates from the work area 62, the velocity of a front implement member is decelerated or stopped at a predetermined degree of deceleration while the direction of a velocity vector of the tip of the bucket 10 computed by the excavation assistance demanded velocity calculating section 76 is maintained. That is, when there is not a possibility that the front work implement 1A reaches the work area boundary 61 from the current posture, the deviation prevention control does not function, but the front work implement 1A operates according to an excavation assistance demanded velocity or an operator operation velocity. In addition, when an excavation assistance demanded velocity of at least one front implement member exceeds a deviation prevention demanded velocity, another front implement member for which an excavation assistance demanded velocity has been computed also is decelerated at the same deceleration ratio. With the configuration in this manner, even if at least one front implement member in a plurality of front implement members (e.g. the arm 9 and the boom 8) is decelerated or stopped by the deviation prevention control in a situation where the plurality of front implement members are operating according to the excavation assistance control, the remaining front implement member is similarly decelerated or stopped according to it, and thus variations of a velocity vector of the bucket tip before and after the activation of a deviation prevention demanded velocity can be prevented.

In addition, in the calculation of the deviation prevention demanded velocity at Step S103, it may be made possible for an operator to change the value of the degree of deceleration da of the subject front implement member, and values of individual front implement members (i.e. individual hydraulic cylinders) may be made changeable. Thereby, for example, by setting the absolute value of a degree of deceleration to a relatively small value for an operator who is inexperienced with operation of the excavator 1, the deviation prevention control intervenes earlier than in a case where the absolute value is relatively large, and the front work implement 1A is decelerated and stopped moderately.

Second Embodiment

The hydraulic excavator 1 according to the present embodiment includes the controller 40 having the deviation prevention demanded velocity calculating section 77 that performs computation processes that are different from the first embodiment. In other respects, the present embodiment is the same as the first embodiment, and the following explains the processes performed by the deviation prevention demanded velocity calculating section 77 by using FIG. 13. Note that processes (Steps S100, S101, S102, and S108) which are processes in FIG. 13, but are the same as those in FIG. 11 of the first embodiment are given the same reference characters, and explanations thereof are omitted.

Figure 14:
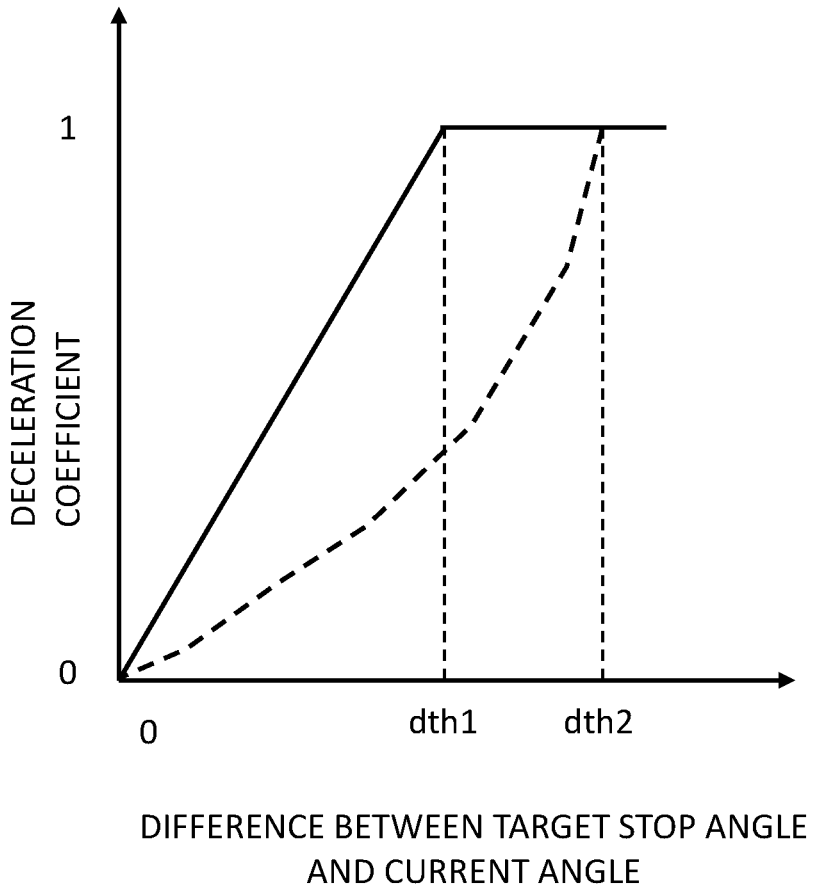
FIG. 14 is a figure depicting the relation between a deceleration coefficient and a difference between a target stop angle and a pivot angle of a front implement member.

At Step S303, for each front implement member decided as being likely to deviate the front work implement 1A from the work area 62 at Step S101, the deviation prevention demanded velocity calculating section 77 calculates a deceleration coefficient on the basis of the current posture (the pivot angle α, β, or γ of each front implement member), and a target stop angle θt. The deceleration coefficient is defined within the range of 0 to 1 as depicted in FIG. 14. The smaller the difference between the target stop angle θt and the current pivot angle is, the smaller the value of the deceleration coefficient is. It is assumed that when the deceleration coefficient is 0, the velocity of the front implement member becomes 0, and when the deceleration coefficient is 1, the front implement member is not decelerated. The relation between the deceleration coefficient, the target stop angle, and the current posture (pivot angle) may be defined linearly from the point where the difference becomes equal to or smaller than dth1 as represented by a solid line, or may be defined by a curve expressed by a polynomial from the point where the difference becomes equal to or smaller than dth2 as represented by a broken line.

At Step S304, it is determined whether a deceleration coefficient of at least one front implement member in the front implement members for which deceleration coefficients have been computed at Step S303 is different from 1, in other words, whether it is necessary to decelerate at least one front implement member from its excavation assistance demanded velocity. Here, when it is determined that a deceleration coefficient of at least one front implement member is different from 1, the process proceeds to Step S305, and when it is not determined so, the process proceeds to Step S108.

At Step S305, the excavation assistance demanded velocities of all the actuators (hydraulic cylinders) for which excavation assistance demanded velocities have been computed are decelerated at the smallest deceleration coefficient in the deceleration coefficients computed at Step S303. For example, when regarding the deceleration coefficients calculated at Step S303, the deceleration coefficient of the boom is 0.2, and the deceleration coefficients of the arm and the bucket are 1, the arm and the bucket are also decelerated at the deceleration coefficient 0.2 at Step S305.

At Step S306, excavation assistance demanded velocities decelerated at Step S305 (deviation prevention demanded velocities) are output as control demanded velocities.

According to the hydraulic excavator including the controller 40 (deviation prevention demanded velocity calculating section 77) that functions in the manner mentioned above, according to a deceleration coefficient of a front implement member whose excavation assistance demanded velocity is decelerated most significantly, excavation assistance demanded velocities of other front implement members are also decelerated. Thereby, similarly to the first embodiment, the operation direction of the bucket 10 defined by the excavation assistance demanded velocity of each front implement member reduced according to the deceleration coefficient matches the operation direction of the bucket 10 defined by the excavation assistance demanded velocity of each front implement member. Because of this, even if the excavation assistance control and the deviation prevention control function simultaneously, the bucket tip moves along the target excavation surface 60, and thus excavation along the target excavation surface 60 becomes possible.

Others

Note that whereas, in the cases explained in the embodiments described above, when the controller controls the front work implement 1A by using both the excavation assistance control and the deviation prevention control, the front work implement 1A is controlled such that the operation direction of the bucket 10 matches the operation direction of the bucket 10 that is to be generated when the front work implement 1A is controlled by using only the excavation assistance control, the front work implement 1A may be controlled such that the operation direction of the bucket 10 approximates to the operation direction of the bucket 10 that is to be generated when the front work implement 1A is controlled by using only the excavation assistance control. That is, the operation directions of the bucket 10 that are seen in both the cases need not to match completely, and they may be different only to such an extent that demanded construction precision of the target excavation surface 60 is satisfied.

In addition, whereas the configuration is explained by mentioning as an example the work machine including electric levers as the operation levers 22 and 23 in the embodiments described above, the present invention can also be applied to a work machine including hydraulic levers.

In addition, in another possible configuration, that both the excavation assistance control and the deviation prevention control are being executed is notified to an operator by using the notification device 46. Examples of the configuration include, for example, a configuration in which that excavation assistance demanded velocities related to at least two front implement members (i.e. a subject front implement member and a remaining front implement member) that are computed by the excavation assistance demanded velocity calculating section 76 of the controller 40 are corrected (decelerated) on the basis of deviation prevention demanded velocities computed by the deviation prevention demanded velocity calculating section 77 is notified by the notification device 46. Furthermore, data (identification data (e.g. names or images of front implement members)) that can identify the at least two front implement members whose excavation assistance demanded velocities are corrected (decelerated) may be notified by the notification device 46. Then, when the at least two front implement members for which computations are performed by the excavation assistance demanded velocity calculating section 76 are stopped by the deviation prevention control, data to that effect or the identification data of the at least two front implement members may be notified by the notification device 46. In addition, when the subject front implement member is decelerated by the deviation prevention control, data to that effect or the identification data of the subject front implement member may be notified by the notification device 46, or when the subject front implement member is stopped, data to that effect or the identification data of the subject front implement member may be notified by the notification device 46. A decision as to whether there is deceleration or a stop may be made by using a deceleration ratio Dr calculated at Step S105 in FIG. 11. In addition, when a notification is made, data (identification data) that can identify a front implement member stopped by the deviation prevention control or data that can specify a front implement member (hydraulic cylinder) whose deceleration ratio Dr is the largest may be provided to an operator. By notifying an operator of a reason why the behavior of the front work implement 1A is changed by the deviation prevention control in the manner mentioned above, a sense of discomfort felt by the operator can be reduced. Note that the form of a notification is not limited to display on a monitor display, but, for example, a warning sound including consecutive buzzer sounds may be output from a speaker, or a warning light may be turned on.

In addition, in another possible configuration that may be adopted as the configuration of the controller 40, excavation assistance demanded velocities are calculated by the excavation assistance demanded velocity calculating section 76, deviation prevention demanded velocities are calculated by the deviation prevention demanded velocity calculating section 77, an arbitrating section that executes a process of arbitrating the demanded velocities (specifically, the processes at Steps S104 to S107 in FIG. 11, and the processes at Steps S304, 305, and 306 in FIG. 13) is installed additionally, and the demanded velocities after being arbitrated are output to the actuator control section 79.

Note that, in the case explained in the description above, as velocities (excavation assistance demanded velocities and deviation prevention demanded velocities) related to the front implement members computed at the excavation assistance demanded velocity calculating section 76 and the deviation prevention demanded velocity calculating section 77, "angular velocities" of the front implement members are computed, and thereafter the actuator control section 79 converts the angular velocities of the front implement members into velocities (actuator velocities) of corresponding hydraulic cylinders. However, in another configuration that can be adopted, as the velocities (excavation assistance demanded velocities and deviation prevention demanded velocities) related to the front implement members computed at the excavation assistance demanded velocity calculating section 76 and the deviation prevention demanded velocity calculating section 77, "velocities of hydraulic cylinders" (actuator velocities) corresponding to the front implement members may be computed, and they may be output to the actuator control section 79.

Note that the present invention is not limited to the embodiments described above, and includes various modification examples within the scope not deviating from the gist of the present invention. For example, the present invention is not limited to those including all the configurations explained in the embodiments described above, but also includes those from which some of the configurations are eliminated. In addition, some of configurations related to an embodiment can be added to or replaced with configurations related to another embodiment.

In addition, each configuration related to the controller described above, and the functionality, execution process and the like of each configuration may be partially or entirely realized by hardware (e.g. designing logic to execute each functionality in an integrated circuit, etc.). In addition, configurations related to the controller described above may be a program (software) that is read out/executed by a computation processing device (e.g. a CPU) to thereby realize each functionality related to the configurations of the controller. Data related to the program can be stored on, for example, a semiconductor memory (a flash memory, an SSD, etc.), a magnetic storage device (a hard disk drive, etc.), a recording medium (a magnetic disc, an optical disc, etc.), and the like.

In addition, whereas control lines and data lines that are deemed to be necessary for the explanation of each embodiment are depicted in the explanation of the embodiment described above, all control lines and data lines related to products are not necessarily depicted. It may be considered that actually almost all configurations are connected mutually.

DESCRIPTION OF REFERENCE CHARACTERS

1: Hydraulic excavator
1A: Front work implement (work implement)
1B: Body (machine body)
5: Boom cylinder
6: Arm cylinder
7: Bucket cylinder
8: Boom
9: Arm
10: Bucket (work tool)
11: Lower travel structure
12: Upper swing structure
14: Bucket link
15: Flow control valve (control valve)
17: Swing angle sensor
19: Swing-angular-velocity sensor
22: Operation lever
23: Operation lever
30: Boom angle sensor
31: Arm angle sensor
32: Bucket angle sensor
33: Body inclination angle sensor
34: Swing angle sensor
40: Controller (controller)
46: Notification device
47*a*-1: Solenoid proportional valve
52: Operation sensor (operator operation sensor)
53: Posture sensor (excavator posture sensor)
55: GNSS antenna
60: Target excavation surface
61: Work area boundary
62: Work area
72: Excavator posture computing section
73: Operator-operation-velocity estimating section
74: Target excavation surface computing section
75: Work area computing section
76: Excavation assistance demanded velocity calculating section (target velocity calculating section)
77: Deviation prevention demanded velocity calculating section (limited velocity calculating section)
78: Notification control section
79: Actuator control section

The invention claimed is:

1. A work machine comprising:

a work implement that is attached to a machine body, and has a plurality of front implement members including a work tool;

a plurality of actuators that drive the machine body and the plurality of front implement members;

an operation device that operates the plurality of actuators;

a posture sensor that senses postural data about the machine body and the work implement;

an operation sensor that senses operation data about the operation device; and a controller configured to control the work implement by using excavation assistance control of controlling the work implement such that the work tool moves along a predetermined target excavation surface and deviation prevention control of preventing deviation of the work implement from a predetermined work area, having a boundary different from the target excavation surface, by decelerating or stopping operation of a subject front implement member, that is included in the plurality of front implement members, which causes the deviation of the work implement from the predetermined work area, wherein when the controller controls the work implement by using both the excavation assistance control and the deviation prevention control, the controller is configured to decelerate or stop the operation of the subject front implement member by the deviation prevention control when the subject front implement member is included in the plurality of front implement members controlled by the excavation assistance control, and based on a deceleration or stopping state of the operation of the subject front implement member, to operate a remaining front implement member excluding the subject front implement member from the plurality of front implement members thereby controlling the work implement such that an operation direction of the work tool approximates to an operation direction of the work tool that is to be generated when the work implement is controlled by using only the excavation assistance control, wherein the controller is configured to:

compute, when the excavation assistance control is used, a target velocity related to at least two front implement members in the plurality of front implement members on a basis of the postural data and the operation data such that the work tool operates along the target excavation surface, compute, when the deviation prevention control is used, a limited velocity related to the subject front implement member on a basis of the postural data such that the work implement does not deviate from the work area, compute, when a target velocity related to the subject front implement member exceeds the limited velocity related to the subject front implement member, a limited velocity related to the remaining front implement member on a basis of the limited velocity related to the subject front implement member, and control operation of the at least two front implement members on a basis of the limited velocity related to the subject front implement member and the limited velocity related to the remaining front implement member.

2. The work machine according to claim 1, wherein the limited velocity related to the remaining front implement member is computed such that an operation direction of the work tool defined by the limited velocity related to the subject front implement member and the limited velocity related to the remaining front implement member approximates to an operation direction of the work tool defined by the target velocities related to the at least two front implement members.

3. The work machine according to claim 1, wherein the limited velocity related to the remaining front implement member is computed such that an operation direction of the work tool defined by the limited velocity related to the subject front implement member and the limited velocity related to the remaining front implement member matches an operation direction of the work tool defined by the target velocities related to the at least two front implement members.

4. The work machine according to claim 1, wherein the controller is configured to:

compute a reference velocity ratio that is a velocity ratio of the limited velocity related to the subject front implement member to the target velocity related to the subject front implement member, compute the limited velocity related to the remaining front implement member that is included in the at least two front implement members for which the target velocities have been computed and that is not the subject front implement member such that a velocity ratio of the limited velocity related to the remaining front implement member to the target velocity related to the remaining front implement member matches the reference velocity ratio, and control operation of the at least two front implement members on a basis of the limited velocity related to the subject front implement member and the limited velocity related to the remaining front implement member.

5. The work machine according to claim 4, wherein the controller is configured to calculate a velocity ratio of each of two or more subject front implement members when there are two or more subject front implement members, and treat, as the reference velocity ratio, a velocity ratio that is smallest in a plurality of calculated velocity ratios.

6. The work machine according to claim 1, further comprising:

a notification device that notifies an operator that velocities related to the subject front implement member and the remaining front implement member are reduced from the target velocities when the controller has computed the limited velocity related to the remaining front implement member on a basis of the limited velocity related to the subject front implement member.

7. The work machine according to claim 6, wherein the notification device notifies an operator of the subject front implement member and the remaining front implement member when the limited velocity related to the remaining front implement member is computed on a basis of the limited velocity related to the subject front implement member.

8. The work machine according to claim 6, wherein the notification device notifies an operator that operation of the subject front implement member has been stopped when the controller has calculated zero as the limited velocity related to the subject front implement member and stopped operation of the subject front implement member.

9. The work machine according to claim 1, wherein the controller calculates the limited velocity related to the subject front implement member on a basis of a degree of deceleration set for the subject front implement member, and wherein the degree of deceleration is changeable.

10. The work machine according to claim 1, further comprising:

a notification device that notifies that the controller controls the work implement by using both the excavation assistance control and the deviation prevention control when such a situation occurs.

11. The work machine according to claim 1, wherein the target velocities related to the at least two front implement members are target velocities of at least two actuators that drive the at least two front implement members, wherein the limited velocity related to the subject front implement member is a limited velocity of an actuator that drives the subject front implement member, wherein the limited velocity related to the remaining front implement member is a limited velocity of an actuator that drives the remaining front implement member, and wherein the controller is configured to control velocities of the at least two actuators on a basis of the limited velocity of the actuator that drives the subject front implement member and the limited velocity of the actuator that drives the remaining front implement member.

12. The work machine according to claim 1, wherein the target velocities related to the at least two front implement members are target velocities of the at least two front implement members, wherein the limited velocity related to the subject front implement member is a limited velocity of the subject front implement member, wherein the limited velocity related to the remaining front implement member is a limited velocity of the remaining front implement member, and wherein the controller is configured to control velocities of the at least two front implement members on a basis of the limited velocity of the subject front implement member and the limited velocity of the remaining front implement member.

* * * * *